US005081008A

United States Patent [19]

Deguchi

[11] Patent Number: 5,081,008

[45] Date of Patent: Jan. 14, 1992

[54] SILVER HALIDE COLOR PHOTOGRAPHIC LIGHT-SENSITIVE MATERIAL CONTAINING A YELLOW FILTER LAYER

[75] Inventor: Naoyasu Deguchi, Minami-ashigara, Japan

[73] Assignee: Fuji Photo Film Co., Ltd., Minami-ashigara, Japan

[21] Appl. No.: 403,880

[22] Filed: Sep. 7, 1989

[30] Foreign Application Priority Data

Sep. 9, 1988 [JP] Japan ..... 63-225918

[51] Int. Cl.[5] ..... G03C 1/825

[52] U.S. Cl. ..... 430/507; 430/510

[58] Field of Search ..... 430/507, 510, 567, 568, 430/220, 569

[56] References Cited

U.S. PATENT DOCUMENTS

| | | | |
|---|---|---|---|
| 2,806,798 | 7/1957 | Weaver | 430/510 |
| 4,052,215 | 10/1977 | Moll et al. | 430/631 |
| 4,429,038 | 1/1984 | Moll et al. | 430/510 |
| 4,542,091 | 9/1985 | Sasaki et al. | 430/380 |

FOREIGN PATENT DOCUMENTS

| | | | |
|---|---|---|---|
| 62-178245 | 8/1987 | Japan . | |
| 1105849 | 7/1984 | U.S.S.R. | 430/507 |
| 569495 | 5/1945 | United Kingdom | 430/507 |

OTHER PUBLICATIONS

The Theory of the Photographic Process, Third Edition, C. E. K. Meath, T. H. James, pp. 278–306.

*Primary Examiner*—Richard L. Schilling
*Assistant Examiner*—Lee C. Wright
*Attorney, Agent, or Firm*—Burns, Doane, Swecker & Mathis

[57] ABSTRACT

In a silver halide color photographic light-sensitive material which includes at least one layer of each of red-, green-, and blue-sensitive silver halide emulsion layers and a yellow filter layer containing yellow colloidal silver on a support, an average grain size of at least one of the light-sensitive silver halide emulsions is 0.4 μm or less, a maximum absorption peak of yellow colloidal silver in the yellow filter layer appears at 430 to 450 nm, and ¼ absorption of the maximum absorption at the longer wavelength side occurs within the range of 500 to 560 nm. This photographic light-sensitive material can reduce a fog by the yellow filter layer without degrading other photographic properties.

4 Claims, No Drawings

SILVER HALIDE COLOR PHOTOGRAPHIC LIGHT-SENSITIVE MATERIAL CONTAINING A YELLOW FILTER LAYER

BACKGROUND OF THE INVENTION

1. Field of the Invention

The present invention relates to a silver halide color photographic light-sensitive material in which a contact fog caused by yellow colloidal silver in a yellow filter layer is suppressed.

2. Description of the Related Art

Normally, a silver halide color photographic light-sensitive material having blue-, green-, and red-sensitive silver halide emulsion layers on a support has unnecessary light sensitivity in a blue light region in a spectral sensitivity distribution of the green and red-sensitive emulsion layers.

In order to obtain good color reproducibility, however, it is preferred that the green-sensitive emulsion layer has color sensitivity mainly in only a green light region and the red-sensitive emulsion layer has color sensitivity mainly in only a red light region.

Therefore, a hydrophilic colloid layer which is arranged so as to face the support across the green-and/or red-sensitive emulsion layers is dyed in yellow to reduce an amount of blue light amount entering the green-and/or red-sensitive emulsion layers, thereby improving the color reproducibility.

A component which dyes the hydrophilic colloid layer in yellow must be discharged or discolored by development. For this reason, yellow colloidal silver or a yellow dye such as a pyrazoloneoxonol dye described in British Patent No. 506,385 or an oxonol barbiturate dye described in U.S. Pat. No. 3,247,127 is normally used.

The yellow dye, however, diffuses to another layer (e.g., if the dye diffuses to a blue-sensitive emulsion layer, the sensitivity of the blue-sensitive layer is lowered) because its dyeing property is bad, or it has a poor discoloring property. Therefore, yellow colloidal silver is normally used.

This yellow colloidal silver can be prepared by various methods.

Satoshi Inoue, "Inorganic Chemistry Manufacturing Test", P. 647 describes, e.g., a method of reducing silver nitrate with dextrin under alkaline conditions, a method of reducing silver nitrate with tannin under alkaline conditions, a method of reducing silver nitrate with hydrazine, and a method of reducing silver oxide with sodium carbonate and hydrogen peroxide in the presence of a silver sol reduced with phosphorus.

When yellow colloidal silver conventionally used in a silver halide color photographic light-sensitive material is dispersed in a hydrophilic colloid layer such as a gelatin layer, its maximum absorption peak appears at 420 nm to 430 nm, and ¼ absorption of the maximum absorption at the longer wavelength side occurs within the range of 480 to less than 500 nm.

If the conventional colloidal silver as described above is used, however, a fog in a light-sensitive silver halide emulsion layer adjacent to a layer in which the colloidal silvers are included is undesirably increased.

A degree of the increase in fog caused by the colloidal silver differs in accordance with a grain size of light-sensitive silver halide grains. That is, as the grain size is decreased, the fog is increased. In particular, if a grain size of silver halide grains in a light-sensitive silver halide emulsion layer adjacent to a yellow colloidal silver layer is small, a fog is significantly increased.

On the contrary, graininess of a light-sensitive silver halide emulsion is normally improved as a grain size of the emulsion is decreased. Therefore, in order to improve the graininess, studies for increasing a sensitivity/grain size ratio have been continuously made by those skilled in the art. According to the studies made by the present inventors, however, as the grain size of silver halide grains is decreased, the fog caused by colloidal silver used in a yellow filter layer is increased, as described above. Especially when the grain size is 0.4 μm or less, an increase in fog is large.

The following method is known as a method of suppressing the fog. That is, Published Examined Japanese Patent Application No. 59-47305 discloses a method of adding $I^-$ to a hydrophilic coloid layer containing colloidal silver or an adjacent non-light-sensitive layer, and Zhun, Nauch, i Priklad, Fot, i Kinematografii, 6, 2256 (1961) discloses a method of adding various non-diffusing reducing agents to a colloidal silver-containing filter layer.

When $I^-$ is added as described above, however, development of a light-sensitive silver halide emulsion is suppressed, or $I^-$ is accumulated in a bleaching and fixing solution used in a development step to reduce a bleaching and fixing speed.

In the method of adding the non-diffusing reducing agent to the filter layer, a bleaching speed of colloidal silver in a development step is reduced, or a fog of a light-sensitive silver halide emulsion is increased when a light-sensitive material is stored under high-temperature and high-humidity conditions.

SUMMARY OF THE INVENTION

It is an object of the present invention to provide a silver halide color photographic light-sensitive material which comprises at least one layer of each of red-, green-, and blue-sensitive silver halide emulsion layers and a yellow filter layer containing yellow colloidal silver, wherein an average grain size of at least one of the light-sensitive silver halide emulsions is 0.4 μm or less, a maximum absorption peak of yellow colloidal silver in the yellow filter layer appears at 430 to 450 nm, and ¼ absorption of the maximum absorption at the longer wavelength side occurs within the range of 500 to 560 nm.

When the color light-sensitive material of the present invention is a color light-sensitive material for picture taking with camera, it is preferred that the maximum absorption peak of yellow colloidal silver in the hydrophilic colloid layer appears at 430 to 445 nm and the ¼ absorption of the maximum absorption at the longer wavelength side occurs within the range of 500 to 540 nm.

When the color light-sensitive material of the present invention is a printing or duplicating color light-sensitive material, it is preferred that the maximum absorption peak of yellow colloidal silver in the hydrophilic colloid layer appears at 430 to 445 nm and the ¼ absorption of the maximum absorption at the longer wavelength side occurs within the range of 500 to 550 nm.

The silver halide color photographic light-sensitive material of the present invention can reduce a fog caused by the yellow filter layer containing yellow colloidal silvers without degrading other photographic properties.

DETAILED DESCRIPTION OF THE PREFERRED EMBODIMENTS

A wavelength of a maximum absorption peak and a wavelength at which ¼ absorption of the maximum absorption occurs of yellow colloidal silver in a hydrophilic colloid layer of the present invention are obtained as follows.

That is, a coating aid and a hardening agent are added to a gelatin dispersion of yellow colloidal silver, and the resultant material is coated on a transparent support. This coated sample is bleached and fixed to obtain a desilvered sample. By using the desilvered sample as a reference, spectral absorption of a yellow colloidal silver coated sample is measured by a spectrophotometer.

Although a coating silver amount of yellow colloidal silver of the present invention is not particularly limited, it is preferably 0.001 to 1.2 g/m$^2$, and more preferably 0.01 to 0.6 g/m$^2$.

Yellow colloidal silver for use in the present invention can be prepared as follows. A preparation method, however, is not limited to the following one.

1. Dextrin (0.1 to 10 kg) is dissolved in distilled water (5 to 100 l), and aqueous hydrogen peroxide solution (31%, 0.01 to 3 l) is added to the solution. NaOH is used to adjust a pH to 10 to 13, and a silver nitrate solution ($AgNO_3$, 1 kg) is added. A temperature is preferably set between 25° C. to 70° C. At a higher temperature, yellow colloidal silver having a maximum absorption peak at a longer wavelength is prepared.

2. $NaBH_4$ (0.02 to 2 kg) is dissolved in distilled water, NaOH is used to adjust a pH to 10 to 13, and a silver nitrate solution ($AgNO_3$, 1 kg) is added.

3. A pH of a silver nitrate solution ($AgNO_3$, 1 kg) is adjusted to 10 to 13 by NaOH, and hydroquinone (0.01 to 10 kg) and $Na_2O_3$ (0.05 to 20 kg) are added to the solution to prepare yellow colloidal silver having a maximum absorption peak at a longer wavelength.

After yellow coloidal silver for use in the present invention is prepared or when a yelow filter layer coating solution is prepared, chlorine ions or bromine ions may be added by using, for example, an alkaline metal chloride, ammonium chloride, an alkaline metal bromide or ammonium bromide.

Alternatively, iodine ions may be added by using, for example, a small amount of an alkaline metal iodide or ammonium iodide.

In the present invention, an average grain size of a silver halide used in at least one emulsion layer is 0.4 μm or less, and preferably, 0.08 to 0.35 μm.

This silver halide is silver iodobromide, silver iodochloride, or silver iodochlorobromide containing about 30 mol% or less of silver iodide. Silver iodobromide containing about 2 mol% to about 25 mol% of silver iodide is most preferable.

A silver halide grain in a light-sensitive silver halide emulsion may have a regular crystal such as a cubic, octahedral, or tetradecahedral crystal, an irregular crystal such as a spherical or tabular crystal, a crystal defect such as a twine plane, or a combination thereof. Although the emulsion grains may be either monodisperse or polydisperse, a monodispersed emulsion having a 20% or less of a variation coefficient is preferred.

The silver halide emulsion for use in the present invention can be prepared by using methods described in, for example, Research Disclosure (RD), No. 17643 (1978, December), PP. 22 and 23, "I. Emulsion Preparation and Types", and RD Nc. 18716 (1979, November), PP. 648; P. Glafkides, "Chimie et Physique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodispersed emulsions described in, e.g., U.S. Pat. Nos. 3,574,628 and 3,655,394, and British Patent No. 1,413,748 are also preferable.

A tabular grain having an aspect ratio of about 2 or more can be used in the present invention. The tabular grain can be easily prepared by methods described in, e.g., Gutoff, "Photographic Science and Engineering", Vol. 14, PP. 248 to 257 (1970); U.S. Pat. Nos. 4,434,226, 4,414,310, 4,433,048, and 4,439,520, and British Patent No. 2,112,157.

A crystal structure of the silver halide grain may be uniform, may have different halogen compositions in its inner and outer portions, or may be a layered structure. Alternatively, a silver halide having a different composition may be bonded by an epitaxial junction, or a compound other than a silver halide such as silver rhodanide or lead oxide may be bonded.

In addition, a mixture of grains having various crystal shapes can be used.

The emulsion grain may be either a surface latent image type in which a latent image is mainly formed on its surface or an internal latent image type in which a latent image is mainly formed inside the grain.

The silver halide emulsion is normally subjected to physical ripering, chemical ripening, and spectral sensitization and then used. Additives used in these steps are described in Research Disclosure Nos. 17643 and 18716, and they are summarized as follows.

| Additives | RD No. 17643 | RD No. 18716 |
|---|---|---|
| 1. Chemical sensitizers | page 23 | page 648, right column |
| 2. Sensitivity increasing agents | | page 648, right column |
| 3. Spectral sensitizers, super sensitizers | pages 23–24 | page 648, right column to page 649, right column |
| 4. Brighteners | page 24 | |
| 5. Antifoggants and stabilizers | pages 24–25 | page 649, right column |
| 6. Light absorbent, filter dye, ultraviolet absorbents | pages 25–26 | page 649, right column to page 650, left column |
| 7. Stain preventing agents | page 25, right column | page 650, left to right columns |
| 8. Dye image stabilizer | page 25 | |
| 9. Hardening agents | page 26 | page 651, left column |
| 10. Binder | page 26 | page 651, left column |
| 11. Plasticizers, lubricants | page 27 | page 650, right column |
| 12. Coating aids, surface active agents | pages 26–27 | page 650, right column |
| 13. Antistatic agents | page 27 | page 650, right column |

In the photographic light-sensitive material of the present invention, an average size of silver halide emulsion grains used in layers different from the above emulsion layer is not particularly limited but may be about 0.1 to 10 μm in accordance with applications.

In addition, a halogen composition of the grains used in layers different from the above emulsion layer is not particularly limited but can be manufactured in the same manner as for the above described emulsion grains.

Known photographic additives which can be used in the present invention are described in the above two RDs and summarized above.

Various color couplers can be used in the present invention. Specific examples of these couplers are described in above-described RD No. 17643, VII-C to VII-G as patent references.

Preferred examples of a yellow coupler are described in, e.g., U.S. Pat. Nos. 3,933,501, 4,022,620, 4,326,024, and 4,401,752, examined Japanese patent application No. (JP-B) 58-10739, and British Patent Nos. 1,425,020 and 1,476,760.

Examples of a magenta coupler are preferably 5-pyrazolone and pyrazoloazole compounds, and more preferably, compounds described in, e.g., U.S. Pat. Nos. 4,310,619 and 4,351,897, EP No. 73,636, U.S. Pat. No. 3,061,432 and 3,725,067, RD No. 24220 (June 1984), JP-A No. 60-33552, RD No. 24230 (June 1984), JP-A No. 60-43659, and U.S. Pat. Nos. 4,500,630 and 4,540,654.

Examples of a cyan coupler are phenol and naphthol couplers, and preferably, those described in. e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, EP No. 121,365A, U.S. Pat. Nos. 3,446,622, 4,333,999, 4,451,559, and 4,427,767, and EP No. 161,626A.

Preferable examples of a colored coupler for correcting additional, undesirable absorption of a colored dye are those described in RD No. 17643, VII-G, U.S. Pat. No. 4,163,670, JP-B No. 57-39413, U.S. Pat. Nos. 4,004,929 and 4,138,258, and British Patent No. 1,146,368.

Typical examples of a polymerized dye-forming coupler are described in U.S. Pat. Nos. 3,451,820, 4,080,211, and 4,367,282, and British Patent No. 2,102,173.

Couplers releasing a photographically useful residue upon coupling ar preferably used in the present invention. DIR couplers, i.e., couplers releasing a development inhibitor are described in the patents cited in the above-described RD No. 17643, VII-F, JP-A Nos. 57-151944, 57-154234, 60-184248, and U.S. Pat. No. 4,248,962.

Preferable examples of a coupler imagewise releasing a nucleating agent or a development accelerator upon development are those described in British Patent Nos. 2,097,140 and 2,131,188, JP-A Nos. 59-157638 and 59-170840.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; DIR redox compound releasing couplers described in, e.g., JP-A No. 60-185950; and a coupler releasing a dye which allows return to an original color after release described in EP No. 173,302A.

The couplers for use in this invention can be introduced in the light-sensitive materials by various known dispersion methods.

The light-sensitive material according to the present invention preferably includes, in addition to the silver halide emulsion layer, auxiliary layers such as a protective layer, an interlayer, a filter layer, an antihalation layer, a back layer, and a white reflecting layer.

In the photographic light-sensitive material of the present invention, the photographic emulsion layer and the other layers are coated on a support described in, e.g., RD No. 17643, Items V to VII (December, 1978), P. 28, EP No. 0,102,253, or JP-A No. 61-97655. A coating method described in RD No. 17643, Item XV, PP. 28 and 29 can be used.

The present invention can be applied to a multilayer, multicolor photographic material having at least two layers with different spectral sensitivities on a support. A multilayer, natural color photographic material normally has at least one layer of each of red-, green-, and blue-sensitive emulsion layers on a support. An order of these layers can be arbitrarily set in accordance with an application. A preferred layer arrangement order is that red-, green-, and blue-sensitive layers or green-, red-, and blue-sensitive layers from a support. Each emulsion layer may consist of two or more emulsion layers having different sensitivities. In addition, a non-light-sensitive layer may be present between two or more emulsion layers having a same color sensitivity. Although cyan, magenta, and yellow forming couplers are normally contained in red-, green-, and blue-sensitive emulsion layers, respectively, different combinations can be made in accordance with applications.

The present invention can be applied to various color light-sensitive materials.

Typical examples are a color reversal film for a slide or TV, color reversal paper, and an instant color film. The present invention can also be applied to a color hard copy for preserving an image obtained by a full-color copying machine or CRT. In addition, the present invention can be applied to a black/white light-sensitive material utilizing three-color coupler mixing described in, e.g., RD No. 17123 (July, 1978).

A color developer used in developing of the light-sensitive material of the present invention is preferably an aqueous alkaline solution containing an aromatic primary amine-based color developing agent as main component. As the color developing agent, although an aminophenol-based compound is effective, a p-phenylenediamine-based compound is preferably used. Typical examples of the p-phenylenediamine-based compound are 3-methyl-4-amino-N,N-diethylaniline, 3-methyl-4-amino-N ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates thereof. These compounds can be used in a combination of two or more thereof in accordance with applications.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, or an aminophenol such as N-methyl-p-aminophenol can be used singly or in a combination of two or more thereof.

The pH of the color and black-and-white developers is generally 9 to 12.

The photographic emulsion layer is generally subjected to bleaching after color development. The bleaching may be performed either simultaneously with fixing (bleach-fixing) or independently of fixing. In addition, in order to increase a processing speed, bleach-fixing may be performed after bleaching.

The silver halide color photographic light-sensitive material of the present invention is normally subjected to washing and/or stabilizing steps after desilvering The pH of the water for washing the light-sensitive material of the present invention is 4 to 9, and preferably, 5 to 8.

The silver halide color light-sensitive material of the present invention may contain a color developing agent in order to simplify processing and increase a processing speed. A color developing agent is preferably contained by using its various precursors.

Each processing solution for use in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The present invention will be described in more detail below by way of its examples. The present invention, however, is not limited to these examples.

Preparation of Yellow Colloidal Silver A

Dextrin is dissolved in distilled water at 40° C., a pH is adjusted to 12.0 by NaOH, and a silver nitrate solution is added. Thereafter, gelatin is added to the resultant solution, and desalting is performed, thereby obtaining yellow colloidal silver A.

Preparation of Yellow Colloidal Silver B

Dextrin is dissolved in water at 40° C. in which a pH is adjusted to 12.0 by NaOH, hydrogen peroxide water is added to the solution, and then a silver nitrate solution is added. Thereafter, gelatin is added to the resultant solution, and desalting is performed, thereby obtaining yellow colloidal silver B.

Preparation of Yellow Colloidal Silver C

Yellow colloidal silver C is prepared following the same procedures as for yellow colloidal silver B except that a water temperature is changed from 40° C. to 60° C.

Preparation of Yellow Colloidal Silver D

A pH of a silver nitrate solution is adjusted to 11.0 by NaOH; and hydroquinone and $Na_2SO_3$ are added to the solution, thereby obtaining yellow colloidal silver D.

Spectral Absorption of Yellow Colloidal Silvers A–D

Maximum Absorption Peak Wavelength (λmax)
Wavelength at which ¼ Absorption of the Maximum Absorption at Longer Wavelength Side (λD/4)

| Yellow Colloidal Silver | λmax (nm) | λD/4 (nm) |
|---|---|---|
| A | 422 | 495 |
| B | 432 | 510 |
| C | 434 | 525 |
| D | 437 | 533 |

EXAMPLE 1

Preparation of Sample 101

A multilayer color light-sensitive material consisting of an undercoated 127 μm thick cellulose traicetate-film support and layers having the following compositions formed on the support was manufactured to prepare a sample 101. Note that structural formulas of compounds described in the following compositions are listed in Table 4 to be presented later.

| | |
|---|---|
| Layer 1: Antihalation Layer: | |
| Gelatin Layer (dry film thickness = 2 μm) | |
| Containing | |
| Black Colloid | 0.25 g/m² |
| Ultraviolet Absorbent U-1 | 0.04 g/m² |
| Ultraviolet Absorbent U-2 | 0.1 g/m² |
| Ultraviolet Absorbent U-3 | 0.1 g/m² |
| High Boiling Organic Solvent O-1 | 0.1 cc/m² |
| Layer 2: Interlayer: | |
| Gelatin Layer (dry film thickness = 1 μm) | |
| Containing | |
| A-14 | 2.5 mg/m² |
| Compound H-1 | 0.05 g/m² |
| Emulsion A silver | 0.05 g/m² |
| High Boiling Organic Solvent O-2 | 0.05 cc/m² |
| Layer 3: 1st Red-Sensitive Emulsion Layer: | |
| Gelatin Layer (dry film thickness = 0.7 μm) | |
| Containing | |
| Monodispersed Silver Iodobromide Emulsion Spectrally Sensitized with Sensitizing Dyes S-1 (0.47 mg/m²) and S-2 (0.02 mg/m²) silver (iodide content = 4 mol %, average grain size = 0.20 μm, variation coefficient of grain size (to be referred to simply as variation coefficient hereinafter) = 12%) | 0.15 g/m² |
| Monodispersed Silver Iodobromide Emulsion Spectrally Sensitized with Sensitizing Dyes S-1 (0.51 mg/m²) and S-2 (0.03 mg/m²) silver (iodide content = 4 mol %, average grain size = 0.40 μm, variation coefficient = 14%) | 0.20 g/m² |
| Emulsion B silver | 0.05 g |
| A-1 | 0.60 mg/m² |
| Coupler C-1 | 0.13 g/m² |
| Coupler C-2 | 0.033 g/m² |
| Coupler C-10 | 0.1 g/m² |
| High Boiling Organic Solvent O-2 | 0.08 cc/m² |
| Layer 4: 2nd Red-Sensitive Emulsion Layer: | |
| Gelatin Layer (dry film thickness = 1.7 μm) | |
| Containing | |
| Monodispersed Silver Iodobromide Emulsion Spectrally Sensitized with Sensitizing Dyes S-1 (1.1 mg/m²) and S-2 (0.04 mg/m²) silver (iodide content = 3 mol %, average grain size = 0.55 μm, variation coefficient = 16%) | 0.53 g/m² |
| A-4 | 0.02 mg/m² |
| Coupler C-1 | 0.40 g/m² |
| Coupler C-2 | 0.07 g/m² |
| Coupler C-9 | 0.05 g/m² |
| High Boiling Organic Solvent O-2 | 0.22 cc/m² |
| Layer 5: 3rd Red-Sensitive Emulsion Layer: | |
| Gelatin Layer (dry film thickness = 1.8 μm) | |
| Containing | |
| Monodispersed Silver Iodobromide Emulsion Spectrally Sensitized with Sensitizing Dyes S-1 (1.1 mg/m²) and S-2 (0.04 mg/m²) silver (iodide content = 2 mol %, average grain size 0.7 μm, variation coefficient = 17%) | 0.53 g/m² |
| A-7 | 1.2 mg/m² |
| Coupler C-6 | 0.35 g/m² |
| Coupler C-8 | 0.20 g/m² |
| High Boiling Organic Solvent O-2 | 0.24 cc/m² |
| Layer 6: Interlayer: | |
| Gelatin Layer (dry film thickness = 1 μm) | |
| Containing | |
| A-10 | 10 mg/m² |
| A-11 | 5 mg/m² |
| Compound H-1 | 0.1 g/m² |

-continued

| | |
|---|---|
| High Boiling Organic Solvent O-2 | 0.1 cc/m² |
| Layer 7: 1st Green-Sensitive Emulsion Layer | |
| Gelatin Layer (dry film thickness = 0.7 μm) Containing | |
| Monodispersed Silver Iodobromide Emulsion Spectrally Sensitized with Sensitizing Dyes S-3 (2.2 mg/m²) and S-4 (1.0 mg/m²) | |
| silver (iodide content = 3 mol %, average grain size = 0.35 μm, variation coefficient = 19%) | 0.5 g/m² |
| Emulsion B silver | 0.05 g/m² |
| A-5 | 0.12 mg/m² |
| Coupler C-3 | 0.27 g/m² |
| High Boiling Organic Solvent O-2 | 0.17 cc/m² |
| Layer 8: 2nd Green-Sensitive Emulsion Layer: | |
| Gelatin Layer (dry film thickness = 1.7 μm) Containing | |
| Monodispersed Internal Latent Image-Type Silver Iodobromide Emulsion Spectrally Sensitized with Sensitizing Dyes S-3 (0.29 g/m²) and S-4 (0.3 mg/m²) | |
| silver (iodide content = 2.5 mol %, average grain size = 0.5 μm, variation coefficient = 18%, distance from latent image to grain surface = 100 Å) | 0.5 g/m² |
| A-6 | 0.2 mg/m² |
| Coupler C-3 | 0.2 g/m² |
| High Boiling Organic Solvent O-2 | 0.13 cc/m² |
| Layer 9: 3rd Green-Sensitive Emulsion Layer: | |
| Gelatin Layer (dry film thickness = 1.7 μm) Containing | |
| Tabular Silver Iodobromide Emulsion Spectrally Sensitized with Sensitizing Dyes S-3 (0.9 mg/m²) and S-4 (0.3 mg/m²) | |
| silver (grains having an iodide content of 2 mol % and a diameter/thickness ratio of 7 or more occupy 50% of a total projected surface area of all of the grains, average grain thickness = 0.10 μm) | 0.5 g/m² |
| A-2 | 1.5 mg/m² |
| Coupler C-3 | 0.2 g/m² |
| Coupler C-4 | 0.1 g/m² |
| High Boiling Organic Solvent O-2 | 0.03 cc/m² |
| Layer 10: Yellow Filter Layer: | |
| Gelatin Layer (dry film thickness = 1 μm) Containing | |
| Yellow Colloidal Silver A | 0.12 g/m² |
| Compound A-15 | 0.22 g/m² |
| Compound H-1 | 0.02 g/m² |
| Compound H-2 | 0.03 g/m² |
| High Boiling Organic Solvent O-2 | 0.04 cc/m² |
| Layer 11: 1st Blue-Sensitive Emulsion Layer: | |
| Gelatin Layer (dry film thickness = 1.5 μm) Containing | |
| Monodispersed Silver Iodobromide Emulsion Spectrally Sensitized with Sensitizing Dye S-33 (1.0 mg/m²) | |
| silver (iodide content = 3 mol %, average grain size = 0.4 μm, variation coefficient = 15%) | 0.6 g/m² |
| Emulsion A | 0.1 g/m² |
| A-7 | 0.5 mg/m² |
| Coupler C-5 | 0.5 g/m² |
| High Boiling Organic Solvent O-2 | 0.1 cc/m² |
| Layer 12: 2nd Blue-Sensitive Emulsion Layer | |
| Gelatin Layer (dry film thickness = 3 μm) Containing | |
| Tabular Silver Iodobromide Emulsion Spectrally Sensitized with Sensitizing Dye S-5 (2.0 mg/m2) | |
| silver (grains having an iodide content of 2.5 mol % and a diameter/thickness ratio of 7 or more occupy 50% of a total projected surface area of all of the grains, average grain thickness = 0.15 μm) | 1.1 g/m² |
| A-12 | 10 mg/m² |
| Coupler C-7 | 1.2 g/m² |
| Coupler C-8 | 0.2 g/m² |
| High Boiling Organic Solvent O-2 | 0.23 cc/m² |
| Layer 13: 1st Protective Layer: | |
| Gelatin Layer (dry film thickness = 2 μm) Containing | |
| A-13 | 0.10 mg/m² |
| Ultraviolet Absorbent U-1 | 0.02 g/m² |
| Ultraviolet Absorbent U-2 | 0.03 g/m² |
| Ultraviolet Absorbent U-3 | 0.03 g/m² |
| Ultraviolet Absorbent U-4 | 0.29 g/m² |
| High Boiling Organic Solvent O-2 | 0.28 cc/m² |
| Layer 14: 2nd Protective Layer: | |
| Gelatin Layer (dry film thickness = 0.8 μm) Containing | |
| Surface-Fogged Fine Silver Iodobromide Emulsion | |
| silver (iodide content = 1 mol %, average grain size = 0.06 μm) | 0.1 g/m² |
| Yellow Colloidal Silver A for Yellow Filter Layer | |
| silver | 0.01 g/m² |
| A-8 | 10 mg/m² |
| Polymethylmethacrylate Grains (average grain size = 1.5 μm) | 0.1 g/m² |
| A-9 | 1.0 mg/m² |

In addition to the above components, a formalin antifoggant A-3, a gelatin hardener H-3, and a surfactant were added to each layer.

Preparation of Emulsions A and B

A silver bromide cubic emulsion having an average grain size of 0.15 μm was prepared by a controlled double jet method and fogged at a low pAg by using hydrazine and gold complex salt (to be referred to as an emulsion A hereinafter).

250 Å-thick shells of silver bromide were formed on the surface of the grains of the emulsion A prepared as described above to prepare an emulsion B.

Preparation of Sample 102

A sample 102 was prepared following the same procedures as for the sample 101 except that a grain size of light-sensitive silver halide grains in the layers 3, 7, and 11 of the sample 101 were set to be 0.45 μm.

Preparation of Sample 103

A sample 103 was prepared following the same procedures as for the sample 102 except that yellow colloidal silver B was used in place of the yellow colloidal silver A of the layer 10 of the sample 102.

Preparation of Sample 104

A sample 104 was prepared following the same procedures as for the sample 101 except that potassium iodide was added to the layer 10 (yellow filter layer) of the sample 101 such that a coating weight became $1.0\times10^{-2}$ g/m².

Preparation of Samples 105-107

Samples 105 to 107 were prepared following the same procedures as for the sample 101 except that colloidal silver listed in Table 1 was used in place of the yellow colloidal silver A in the layer 10 of the sample 101.

The samples 101 to 107 prepared as described above were exposed with white light through a continuous optical wedge and subjected to the following development processing, and densities of cyan, magenta, and yellow were measured. At this time, a maximum density (Dmax) and a relative sensitivity with a density of 1.0 were obtained. In the case of a color reversal light-sensitive material, as the Dmax is increased, a fog is reduced. In addition, remaining silver amounts of the developed samples were measured to compare desilvering properties.

In order to compare graininesses, a value 1,000 times an RMS graininess at a portion having a density of 1.0 was obtained. The results are listed in Table 1.

| Process | Time | Temperature | Tank Volume | Replenishing Solution |
|---|---|---|---|---|
| 1st Development | 6 min. | 38° C. | 12 l | 2200 ml/m$^2$ |
| 1st Washing | 45 sec. | 38° C. | 2 l | 2200 ml/m$^2$ |
| Reversal | 45 sec. | 38° C. | 2 l | 1100 ml/m$^2$ |
| Color Development | 6 min. | 38° C. | 12 l | 2200 ml/m$^2$ |
| Bleaching | 2 min. | 38° C. | 4 l | 800 ml/m$^2$ |
| Bleach-Fixing | 4 min. | 38° C. | 8 l | 1100 ml/m$^2$ |
| 2nd Washing (1) | 1 min. | 38° C. | 2 l | — |
| 2nd Washing (2) | 1 min. | 38° C. | 2 l | 1100 ml/m$^2$ |
| Stabilizing | 1 min. | 25° C. | 2 l | 1100 ml/m$^2$ |
| Drying | 1 min. | 65° C. | — | — |

A replenishing system of washing water was a so-called counterflow replenishing system in which the washing water was replenished in a second washing bath (2) and an overflow solution of the second washing bath (2) was introduced to a second washing bath (1).

Compositions of the respective processing solutions were as follows.

1st Devalopment

| | Mother Solution | Replenishing Solution |
|---|---|---|
| Pentasodium Nitrilo-N,N,N-trimethylenephosphonate | 2.0 g | 2.0 g |
| Sodium Sulfite | 30 g | 30 g |
| Potassium Hydroquinonemonosulfonate | 20 g | 20 g |
| Potassium Carbonate | 33 g | 33 g |
| 1-phenyl-4-methyl-4-hydroxydimethyl-3-pyrazolidone | 2.0 g | 2.0 g |
| Potassium Bromide | 2.5 g | 1.4 g |
| Potassium thiocyanate | 1.2 g | 1.2 g |
| Potassium Iodide | 2.0 mg | — — |
| Water to make | 1,000 ml | 1,000 ml |
| pH | 9.60 | 9.60 |

The pH was adjusted by hydrochloric acid or potassium hydroxide.

1st Washing Solution

| | Mother Solution | Replenishing Solution |
|---|---|---|
| Ethylenediamine-tetramethylenephosphonic Acid | 2.0 g | the same as mother solution |
| Disodium Phosphate | 5.0 g | |
| Water to make | 1,000 ml | |
| pH | 7.00 | |

The pH was adjusted by hydrochloric acid or sodium hydroxide.

Reversal Solution

| | Mother Solution | Replenishing Solution |
|---|---|---|
| Pentasodium Nitrilo-N,N,N-trimethylenephosphonate | 3.0 g | the same as mother solution |
| Stannous Chloride (Dihydrate) | 1.0 g | |
| p-aminophenol | 0.1 g | |
| Sodium hydroxide | 8 g | |
| Glacial Acetic Acid | 15 ml | |
| Water to make | 1000 ml | |
| pH | 6.00 | |

The pH was adjusted by hydrochloric acid or sodium hydroxide.

| Color Developer | Mother Solution | Replenishing Solution |
|---|---|---|
| Pentasodium Nitrilo-N,N,N-trimethylenephosphonate | 2.0 g | 2.0 g |
| Sodium Sulfite | 7.0 g | 7.0 g |
| Trisodiume phosphate (dodecahydrate) | 36 g | 36 g |
| Potassium Bromide | 1.0 g | — |
| Potassium Iodide | 90 mg | — |
| Sodium hydroxide | 3.0 g | 3.0 g |
| Citrazinic acid | 1.5 g | 1.5 g |
| N-ethyl-N-(β-methanesulfonamidoethyl)-3-methyl-4-aminoaniline Sulfate | 11 g | 11 g |
| 3,6-dithiaoctane-1,8-diol | 1.0 g | 1.0 g |
| Water to make | 1000 ml | 1000 ml |
| pH | 11.80 | 12.00 |

The pH was adjusted by hydrochloric acid or potassium hydroxide.

| Bleaching Solution | Mother Solution | Replenishing Solution |
|---|---|---|
| Disodium Ethylenediamine-tetraacetate (Dihydrate) | 10.0 g | the same as mother solution |
| Ferric (III) Ammonium Ethylenediaminetetraacetate (Dihydrate) | 120 g | |
| Ammonium Bromide | 100 g | |
| Ammonium Nitrate | 10 g | |
| Bleaching Accelerator | 0.005 mol | |

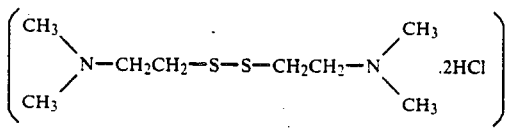

-continued

| Bleaching Solution | Mother Solution | Replenishing Solution |
|---|---|---|
| Water to make | 1,000 ml | |
| pH | 6.30 | |

The pH was adjusted by hyrochloric acid or ammonia water.

| Bleach-Fixing Solution | Mother Solution | Replenishing Solution |
|---|---|---|
| Ferric (III) Ammonium Ethylenediaminetetraacetate (Dihydrate) | 50 g | the same as mother solution |
| Disodium Ethylenediaminetetraacetate (Dihydrate) | 5.0 g | |
| Ammonium Thiosulfate | 80 g | |
| Sodium Sulfite | 12.0 g | |
| Water to make | 1,000 ml | |
| pH | 6.60 | |

The pH was adjusted by hydrochloric acid or ammonia water.

2nd Washing Solution

Tap water was supplied to a mixed-bed column filled with an H type strongly acidic cation exchange resin (Amberlite IR-120B, available from Rohm & Haas Co.) and an OH type anion exchange resin (Amberlite IR-400) to set the concentrations of calcium and magnesium to be 3 mg/l or less. Subsequently, 20 mg/l of sodium isocyanurate dichloride and 1.5 g/l of sodium sulfate were added, thereby mother and replenishing solution were obtained. The pH of the solution fell within the range of 6.5 to 7.5.

| Stabilizing Solution | Mother Solution | Replenishing Solution |
|---|---|---|
| Formalin (37%) | 5.0 ml | the same as mother solution |
| Polyoxyethylene-p-monononyl-phenylether (average polymerization degree = 10) | 0.5 ml | |
| Water to make | 1,000 ml | |
| pH | not adjusted | |

TABLE

| Sample No. | Yellow Colloidal Silver used in Layer 10 | Additive added to Layer 10 | Relative Sensitivity Cyan | Relative Sensitivity Magenta | Relative Sensitivity Yellow | $D_{max}$ Cyan | $D_{max}$ Magenta | $D_{max}$ Yellow | RMS Cyan | RMS Magenta | RMS Yellow | Remaining Silver Amount |
|---|---|---|---|---|---|---|---|---|---|---|---|---|
| 101 (comparative Example) | A | — | 100 | 100 | 100 | 2.81 | 2.95 | 2.98 | 17.5 | 17.8 | 32.3 | 6.2 mg/cm$^2$ |
| 102 (comparative Example) | A | — | 108 | 105 | 107 | 2.85 | 3.04 | 3.06 | 18.7 | 18.9 | 32.9 | 6.4 |
| 103 (comparative Example) | B | — | 109 | 104 | 106 | 2.88 | 3.12 | 3.14 | 18.6 | 18.9 | 32.9 | 6.[illegible] |
| 104 (comparative Example) | A | KI | 96 | 90 | 92 | 2.82 | 3.01 | 3.06 | 17.4 | 17.7 | 32.3 | 11.5 |
| 105 (Present Invention) | B | — | 101 | 100 | 102 | 2.91 | 3.16 | 3.19 | 17.5 | 17.7 | 32.3 | 6.1 |
| 106 (Present Invention) | C | — | 99 | 101 | 100 | 2.90 | 3.17 | 3.22 | 17.4 | 17.8 | 32.4 | 6.0 |
| 107 (Present Invention) | D | — | 98 | 101 | 102 | 2.91 | 3.15 | 3.20 | 17.5 | 17.7 | 32.3 | 6.2 |

As is apparent from the results shown in Table 1, according to the present invention, the Dmax is increased higher (fog is decreased lower) than in the comparative examples without degrading the graininess, sensitivity, and desilvering performance.

EXAMPLE 2

The following layers 1 to 14 were formed on the upper surface of a paper support (thickness = 100 μm) whose surfaces were laminated with polyethylene, and the layers 15 and 16 were coated on its lower surface, thereby preparing a color photographic light-sensitive material. The polyethylene at the layer 1 side contained titanium oxide as a white pigment and a small amount of ultramarine blue as a bluing dye (chromaticity by L*, a*, and b* systems on the surface of the support were 88.0, −0.20, and −0.75, respectively).

Light-Sensitive Layer Compositions

Components and coating weights (in units of g/m²) will be presented below. Note that silver halides are represented by silver-converted coating weights. Emulsions used in the respective layers were prepared following the same procedures as for an emulsion EM1 to be described later. Note that a Lippmann emulsion not subjected to surface chemical sensitization was used as an emulsion in the layer 14. Structural formulas of compounds described in the compositions are listed in Table 5 to be presented later.

| | |
|---|---|
| Layer 1: Antihalation Layer: | |
| Black Colloidal Silver | 0.10 |
| Gelatin | 0.70 |
| Layer 2: Interlayer: | 0.70 |
| Gelatin | |
| Layer 3: Low-Sensitivity Red-Sensitive Layer: | |
| Silver Bromide (average grain size = 0.25 μm, size distribution [variation coefficient] = 8%, octahedral grains) Spectrally Sensitized with Red Sensitizing Dyes (ExS-1, 2, and 3) | 0.04 |
| Silver Chlorobromide (silver chloride = 5 mol %, average grain size = 0.40 μm, size distribution = 10%, octahedral grains) Spectrally Sensitized with Red Sensitizing Dyes (ExS-1, 2, and 3) | 0.08 |
| Gelatin | 1.00 |
| Cyan Couplers (ExC-1: -2: -3: -4 = 1:1:0.2:0.01) | 0.30 |
| Decoloration Inhibitors (equal amount of Cpd-1, 2, 3 and 4) | 0.18 |
| Stain Inhibitor (Cpd-5) | 0.003 |
| Coupler Dispersion Medium (Cpd-6) | 0.03 |
| Coupler Solvents (equal amount of Solv-1, 2 and 3) | 0.12 |
| Layer 4: High-Sensitivity Red-Sensitive Layer: | |
| Silver Bromide (average grain size = 0.60 μm, size distribution = 15%, octahedral grains) Spectrally Sensitized with Red Sensitizing Dyes (ExS-1, 2, and 3) | 0.14 |
| Gelatin | 1.00 |
| Cyan Couplers (ExC-1: -2: -3: -4 = 1:1:0.2:0.01) | 0.30 |
| Decoloration Inhibitors (equal amount of Cpd-1, 2, 3 and 4) | 0.18 |
| Coupler Dispersion Medium (Cpd-6) | 0.03 |
| Coupler Solvents (equal amount of Solv-1, 2 and 3) | 0.12 |
| Layer 5: Interlayer: | |
| Gelatin | 1.00 |
| Color-Mixing Inhibitor (Cpd-7) | 0.08 |
| Color-Mixing Inhibitor Solvents (equal amount of Solv-4 and 5) | 0.16 |
| Polymer Latex (Cpd-8) | 0.10 |
| Layer 6: Low-Sensitivity Green-Sensitive Layer: | |
| Silver Bromide (average grain size = 0.25 μm, size distribution = 8%, octahedral grains) Spectrally Sensitized with Green Sensitizing Dye (ExS-4) | 0.04 |
| Silver Chlorobromide (silver chloride = 5 mol %, average grain size = 0.40 μm, size distribution = 10%, octahedral grains) Spectrally Sensitized with Green Sensitizing Dye (ExS-4) | 0.06 |
| Gelatin | 0.80 |
| Magenta Couplers (equal amount of ExM-1, 2 and 3) | 0.11 |
| Cyan Coupler (ExC-4) | 0.001 |
| Decoloration Inhibitors (equal amount of Cpd-9 and 26) | 0.15 |
| Stain Inhibitor (Cpd-10: -11: -12: -13 = 10:7:7:1) | 0.025 |
| Coupler Dispersion Medium (Cpd-6) | 0.05 |
| Coupler Solvents (equal amount of Solv-4 and 6) | 0.15 |
| Layer 7: High-Sensitivity Green-Sensitive Layer: | |
| Silver Bromide (average grain size = 0.65 μm, size distribution = 16%, octahedral grains) Spectrally Sensitized with Green Sensitizing Dye (ExS-4) | 0.10 |
| Gelatin | 0.80 |
| Magenta Couplers (equal amount of ExM-1, 2 and 3) | 0.11 |
| Cyan Coupler (ExC-4) | 0.001 |
| Decoloration Inhibitors (equal amount of Cpd-9 and 26) | 0.15 |
| Stain Inhibitors (Cpd-10: -11: -12: -13 = 10:7:7:1) | 0.025 |
| Coupler Dispersion Medium (Cpd-6) | 0.05 |
| Coupler Solvents (equal amount of Solv-4 and 6) | 0.15 |
| Layer 8: Interlayer: | |
| The same as the layer 5 | |
| Layer 9: Yellow Filter Layer: | |
| Yellow Colloidal Silver A | 0.12 |
| Gelatin | 0.07 |
| Color-Mixing Inhibitor (Cpd-7) | 0.03 |
| Color-Mixing Inhibitor Solvents (equal amount of Solv-4 and 5) | 0.10 |
| Polymer Latex (Cpd-8) | 0.07 |
| Layer 10: Interlayer: | |
| The same as the layer 5 | |
| Layer 11: Low-Sensitivity Blue-Sensitive Layer: | |
| Silver Bromide (average grain size = 0.40 μm, size distribution = 8%, octahedral grains) Spectrally Sensitized with Blue Sensitizing Dyes (ExS-5 and 6) | 0.07 |
| Silver Chlorobromide (silver chloride = 8 mol %, average grain size = 0.60 μm, size distribution = 11%, octahedral grains) Spectrally Sensitized with Blue Sensitizing Dyes (ExS-5 and 6) | 0.14 |
| Gelatin | 0.80 |
| Yellow Couplers (equal amount of ExY-1 and 2) | 0.35 |
| Cyan Coupler (ExC-4) | 0.0035 |
| Decoloration Inhibitor (Cpd-14) | 0.10 |
| Stain Inhibitor (Cpd-5: -15 = 1:5) | 0.007 |
| Coupler Dispersion Medium (Cpd-6) | 0.05 |
| Coupler Solvent (Solv-2) | 0.10 |
| Layer 12: High-Sensitivity Blue-Sensitive Layer: | |
| Silver Bromide (average grain size = 0.85 μm, size distribution = 18%, octahedral grains) Spectrally Sensitized with Blue Sensitizing Dyes (ExS-5 and 6) | 0.15 |
| Gelatin | 0.60 |
| Yellow Couplers (equal amount of ExY-1 and 2) | 0.30 |
| Cyan Coupler (ExC-4) | 0.003 |
| Decoloration Inhibitor (Cpd-14) | 0.10 |
| Stain Inhibitor (Cpd-5: -15 = 1:5) | 0.007 |
| Coupler Dispersion Medium (Cpd-6) | 0.05 |
| Coupler Solvent (Solv-2) | 0.10 |
| Layer 13: High-Sensitivity Blue-Sensitive Layer: | |
| Gelatin | 1.00 |
| Ultraviolet Absorbents (equal amount of Cpd-2, 4 and 16) | 0.50 |
| Color-Mixing Inhibitors (equal amount of Cpd-7 and 17) | 0.03 |
| Dispersion Medium (Cpd-6) | 0.02 |
| Ultraviolet Absorbent Solvents (equal amount of Solve-2 and 7) | 0.08 |
| Irradiation Inhibiting Dyes (Cpd-18: -19: -20: -21: -27 = 10:10:13:15:20) | 0.05 |
| Layer 14: Protective Layer: | |
| Fine Grain Silver Chlorobromide (silver chloride = 97 mol %, average size = 0.1 μm) | 0.03 |
| Acryl-Modified Copolymer of Polyvinyl Alcohol | 0.01 |
| Polymethylmethacrylate Grains (average grain size = 2.4 μm) and Silicon Oxide (average grain size = 5 μm) equal amount | 0.05 |

-continued

| | |
|---|---|
| Gelatin | 1.80 |
| Gelatin Hardeners (equal amount of H-4 and H-5) | 0.18 |
| Layer 15: Back Layer: | |
| Gelatin | 2.50 |
| Ultraviolet Absorbents (equal amount of Cpd-2, 4 and 16) | 0.50 |
| Dyes (equal amount of Cpd-18, 19, 20, 21 and 27) | 0.06 |
| Layer 16: Lower Surface Protective Layer: | |
| Polymethylmethacrylate Grains (average grain size = 2.4 μm) and Silicon Oxide (average grain size = 5 μm) equal amount | 0.05 |
| Gelatin | 2.00 |
| Gelatin Hardeners (equal amount of H-4 and H-5) | 0.14 |

Preparation of Emulsion EM-1

Aqueous solutions of potassium bromide and silver nitrate were simultaneously added to an aqueous gelatin solution under vigorous stirring at 75° C. over 15 minutes to obtain octahedral silver bromide grains having an average grain size of 0.40 μm. 3,4-dimethyl-1,3-thiazoline-2-thion, sodium thiosulfate, and chloroauric acid (tetrahydrate) were sequentially added in amounts of 0.3 g, 6 mg, and 7 mg per mol of silver, respectively, to the resultant grains and then the grains were heated at 75° C. for 80 minutes, thereby performing chemical sensitization. The resultant grains were used as a core and precipitated in the same precipitation environment as in the first time, thereby finally obtaining an octahedral monodispersed core/shell silver bromide emulsion which contains the grains having an average grain size of 0.7 μm. A variation coefficient in grain size was about 10%. Sodium thiosulfate and chloroauric acid (tetrahydrate) were added in amounts of 1.5 mg per mol of silver, respectively, to the emulsion and then the emulsion was heated at 60° C. for 60 minutes to perform chemical sensitization, thereby obtaining an internal latent image type silver halide emulsion.

In each light-sensitive layer, ExZK-1 and ExZK-2 wire used as a nucleating agent in amounts of $10^{-3}$ and $10^{-2}$ wt% with respect to the silver halide, respectively, and Cpd-22 was used as a nucleation accelerator in an amount of $10^{-2}$ wt% with respect to the silver halide. In addition, in each layer, Akanol XC (Du Pont de Nemours, E.I., Co.) and sodium alkylbenzenesulfonate were used as an emulsifying/dispersing agent, and succinate and Magefac F-120 (DAI NIPPON PRINTING CO., LTD.) were used as a coating aid. In silver halide- and colloidal silver-containing layers, Cpd-23, Cpd-24, and Cpd-25 were used as a stabilizer. This sample was used as a sample 201.

Preparation of Sample 202

A sample 202 was prepared following the same procedures as for the sample 201 except that an average grain size of the light-sensitive silver halide grains in the layers 3, 6, and 11 of the sample 201 was set to be 0.5 μm, respectively.

Preparation of Sample 203

A sample 203 was prepared following the same procedures as for the sample 201 except that potassium iodide was added to the layer 9 of the sample 201 such that a coating weight became $0.7\times10^{-2}$ g/m$^2$.

Preparation of Samples 204–206

Samples 204 to 206 were prepared following the same procedures as for the sample 201 except that colloidal silver shown in Table 2 was used in place of the yellow colloidal silver A in the layer 9 of the sample 201.

Preparation of Samples 207 and 208

Samples 207 and 208 were prepared following the same procedures as for the samples 204 and 205 except that potassium bromide was added to the yellow filter layers of the samples 204 and 205 such that a coating weight became $0.6\times10^{-2}$ g/m$^2$, respectively.

The samples 201 to 20B prepared as described above were exposed with white llight through a continuous optical wedge and subjected to the following development, and cyan, magenta, and yellow densities were measured. A developing speed is decreased as a maximum density (Dmax) is decreased, and a fog is increased as a minimum density (Dmin) is increased.

In addition, remaining silver amounts of the developed samples were measured. As the remaining silver amount is increased, a desilvering speed is decreased.

The results are listed in Table 2.

| Process | Time | Temperature | Mother Solution Tank Volume | Replenishing Amount |
|---|---|---|---|---|
| Color Development | 135 sec. | 38° C. | 15 λ | 300 mλ/m$^2$ |
| Bleach-Fixing | 40 sec. | 33° C. | 3 λ | 300 mλ/m$^2$ |
| Wash (1) | 40 sec. | 33° C. | 3 λ | — |
| Wash (2) | 40 sec. | 33° C. | 3 λ | 320 mλ/m$^2$ |
| Dry | 30 sec. | 80° C. | | |

A replenishing system of washing water was a so-called counterflow replenishing system in which the washing water was replenished in a washing bath (2) and an overflow solution of the washing bath (2) was guided to a washing bath (1). At this time, an amount of a bleach-fixing solution carried by the light-sensitive material from a bleach-fixing bath to the washing bath (1) was 35 ml/m$^2$ and a ratio of a replenishing amount of the washing water with respect to the amount of the carried bleach-fixing solution was 9.1.

Compositions of the respective processing solutions were as follows.

| | Mother Solution | Replenishing Solution |
|---|---|---|
| Color Developer | | |
| D-Sorbitol | 0.15 g | 0.20 g |
| Condensate of Sodium Naphthalenesulfonate and Formalin | 0.15 g | 0.20 g |
| Ethylenediaminetetrakis-methylenephosphonic acid | 1.5 g | 1.5 g |
| Diethylene Glycol | 12.0 | 16.0 |
| Benzyl Alcohol | 13.5 | 18.0 |
| Pbtassium Bromide | 0.80 g | — |
| Benzotriazol | 0.003 g | 0.004 g |
| Sodium Sulfite | 2.4 g | 3.2 g |
| N,N-bis(carboxymethyl)hydrazine | 6.0 g | 8.0 g |
| D-glucose | 2.0 g | 2.4 g |
| Triethanolamine | 6.0 g | 8.0 g |
| N-ethyl-N-β-methanesulfonamido-ethyl)-3-methyl-4-aminoaniline Sulfate | 6.4 g | 8.5 g |
| Potassium Carbonate | 30.0 g | 25.0 g |
| Fluorescent Brightener | 1.0 g | 1.2 g |

-continued

| | Mother Solution | Replenishing Solution |
|---|---|---|
| (diaminostilbene-based) | | |
| Water to make | 1,000 mλ | 1,000 mλ |
| pH (25° C.) | 10.50 | 11.00 |
| Bleach-Fixing Solution | | |
| Disodium Ethylenediaminetetraacetate (Dihydrate) | 4.0 g | the same as mother solution |
| Ferric (III) Ammonium Ethylenediaminetetraacetate (Dihydrate) | 70.0 g | |
| Ammonium Thiosulfate (700 g/λ) | 180 mλ | |
| Sodium p-toluenesulfinate | 20.0 g | |
| Sodium Bisulfite | 20.0 g | |
| 5-mercapto-1,3,4-triazole | 0.5 g | |
| Ammonium Nitrate | 10.0 g | |
| Water to make | 1,000 mλ | |
| pH (25° C.) | 6.20 | |

Washing Solution

Tap water was supplied to a mixed-bed column filled with an H type strongly acidic cation exchange resin (Amberlite IR-120B, available from Rohm & Haas Co.) and an OH type anion exchange resin (Amberlite IR-400) to set the concentrations of calcium ion and magnesium ion to be 3 mg/l or less. Subsequently, 20 mg/l of sodium isocyanurate dichloride and 0.15 g/l of sodium sulfate were added, thereby mother and replenishing solution were obtained. The pH of the solution fell within the range of 6.5 to 7.5.

TABLE 2

| Sample No. | Yellow Colloidal Silver used in Layer 9 | Additives added to Layer 9 | $D_{max}$ Cyan | $D_{max}$ Magenta | $D_{max}$ Yellow | $D_{min}$ Cyan | $D_{min}$ Magenta | $D_{min}$ Yellow | Remaining Silver Amount |
|---|---|---|---|---|---|---|---|---|---|
| 201 (Comparative Example) | A | — | 2.14 | 2.20 | 2.18 | 0.15 | 0.19 | 0.23 | 3.2 mg/cm² |
| 202 (Comparative Example) | A | — | 1.95 | 2.02 | 2.04 | 0.15 | 0.19 | 0.23 | 3.1 |
| 203 (Comparative Example) | A | KI | 2.09 | 2.15 | 2.12 | 0.15 | 0.18 | 0.21 | 8.5 |
| 204 (Present Invention) | B | — | 2.14 | 2.21 | 2.20 | 0.14 | 0.16 | 0.16 | 3.1 |
| 205 (Present Invention) | C | — | 2.14 | 2.20 | 2.22 | 0.14 | 0.16 | 0.15 | 3.0 |
| 206 (Present Invention) | D | — | 2.14 | 2.21 | 2.19 | 0.14 | 0.16 | 0.16 | 3.2 |
| 207 (Present Invention) | B | KBr | 2.13 | 2.20 | 2.19 | 0.14 | 0.15 | 0.15 | 3.2 |
| 208 (Present Invention) | C | KBr | 2.14 | 2.19 | 2.19 | 0.14 | 0.15 | 0.15 | 3.2 |

As is apparent from the results shown in Table 2, according to the present invention, a fog can be reduced lower than in the comparative examples without decreasing the developing speed and desilvering speed.

EXAMPLE 3

A sample 301 as a multilayered color light-sensitive material consisting of an undercoated cellulose triacetate-film support and layers having the following compositions formed on the support was prepared.

Compositions of Light-Sensitive Layers

The coating weight of a silver halide and colloidal silver are represented in units of g/m² of silver, that of couplers, additives, and gelatin is represented in units of g/m², and that of sensitizing dyes is represented by the mols per mol of the silver halide in the same layer. Symbols representing additives have the following meanings. Note that if an additive has a plurality of effects, only one of the effects is shown. Structural formulas of the additives are listed in Table 6 to be presented later.

UV; ultraviolet absorbent, Solv; high-boiling organic solvent, ExF; dye, ExS; sensitizing dye, ExC; cyan coupler, ExM; magenta coupler, ExY; yellow coupler, Cpd; additive

| | |
|---|---|
| Layer 1: Antihalation Layer | |
| Black Colloidal Silver | 0.15 |
| Gelatin | 2.9 |
| UV-1 | 0.03 |
| UV-2 | 0.06 |
| UV-3 | 0.07 |
| Solv-5 | 0.08 |
| ExF-1 | 0.01 |
| ExF-2 | 0.01 |
| Layer 2: Low-Sensitivity Red-Sensitive Emulsion Layer | |
| Silver Iodobromide Emulsion (AgI = 4 mol %, homogeneous AgI type, sphere-equivalent diameter = 0.35 μm, variation coefficient of sphere-equivalent diameter = 37%, tabular grain, diameter/thickness ratio = 3.0) coating silver weight | 0.4 |
| Gelatin | 0.8 |
| ExS-7 | $2.3 \times 10^{-4}$ |
| ExS-2 | $1.4 \times 10^{-4}$ |
| ExS-10 | $2.3 \times 10^{-4}$ |
| ExS-1 | $8.0 \times 10^{-6}$ |
| ExC-5 | 0.17 |
| ExC-6 | 0.03 |
| ExC-7 | 0.13 |

-continued

| | |
|---|---|
| Layer 3: Intermediate-Sensitivity Red-Sensitive Emulsion Layer | |
| Silver Iodobromide Emulsion (AgI = 6 mol %, internally high AgI type having core/shell ratio of 2:1, sphere-equivalent diameter = 0.65 μm, variation coefficient of sphere-equivalent diameter = 25%, tabular grains, diameter/thickness ratio = 2.0) coating silver weight | 0.65 |
| Silver Iodobromide Emulsion (AgI = 4 mol %, homogeneous AgI type, sphere-equivalent diameter = 0.6 μm, variation coefficient of sphere-equivalent diameter = 37%, tabular grain, diameter/thickness ratio = 3.0) coating silver weight | 0.1 |
| Gelatin | 1.0 |
| ExS-7 | $2 \times 10^{-4}$ |
| ExS-2 | $1.2 \times 10^{-4}$ |
| ExS-10 | $2 \times 10^{-4}$ |
| ExS-1 | $7 \times 10^{-6}$ |
| ExC-5 | 0.31 |
| ExC-6 | 0.01 |
| ExC-7 | 0.06 |
| Layer 4: High-Sensitivity Red-Sensitive Emulsion Layer | |
| Silver Iodobromide Emulsion (AgI = 6 mol %, internally high AgI type having core/shell ratio of 2:1, sphere-equivalent diameter = 0.7 μm, variation coefficient of sphere-equivalent diameter = 25%, tabular grain, diameter/thickness ratio = 2.5) coating silver weight | 0.9 |
| Gelatin | 0.8 |
| ExS-7 | $1.6 \times 10^{-4}$ |
| ExS-2 | $1.6 \times 10^{-4}$ |
| ExS-10 | $1.6 \times 10^{-4}$ |
| ExS-1 | $6 \times 10^{-4}$ |
| ExC-5 | 0.07 |
| ExC-8 | 0.05 |
| Solv-4 | 0.07 |
| Solv-5 | 0.20 |
| Cpd-28 | $4.6 \times 10^{-4}$ |
| Layer 5: Interlayer | |
| Gelatin | 0.6 |
| UV-4 | 0.03 |
| UV-5 | 0.04 |
| Cpd-29 | 0.1 |
| Polyethylacrylate Latex | 0.08 |
| Solv-4 | 0.05 |
| Layer 6: Low-Sensitivity Green-Sensitive Emulsion Layer | |
| Silver Iodobromide Emulsion (AgI = 4 mol %, homogeneous AgI type, sphere-equivalent diameter = 0.3 μm, variation coefficient of sphere-equivalent diameter = 37%, tabular grain, diameter/thickness ratio = 2.0) coating silver weight | 0.18 |
| Gelatin | 0.4 |
| ExS-8 | $2 \times 10^{-4}$ |
| ExS-9 | $7 \times 10^{-4}$ |
| ExS-10 | $1 \times 10^{-4}$ |
| ExM-5 | 0.11 |
| ExM-7 | 0.03 |
| ExY-8 | 0.01 |
| Solv-4 | 0.09 |
| Solv-8 | 0.01 |
| Layer 7: Intermediate-Sensitivity Green-Sensitive Emulsion Layer | |
| Silver Iodobromide Emulsion (AgI = 4 mol %, surface high AgI type having cor/shell ratio of 1:1, sphere-equivalent diameter = 0.6 μm, variation coefficient of sphere-equivalent diameter = 20%, tabular grain, diameter/thickness ratio = 4.0) coating silver weight | 0.27 |
| Gelatin | 0.6 |
| ExS-8 | $2 \times 10^{-4}$ |
| ExS-9 | $7 \times 10^{-4}$ |
| ExS-10 | $1 \times 10^{-4}$ |
| ExM-5 | 0.17 |
| ExM-7 | 0.04 |
| ExM-8 | 0.02 |
| Solv-4 | 0.14 |
| Solv-8 | 0.02 |
| Layer 8: Intermediate-Sensitivity Green-Sensitive Emulsion Layer | |
| Silver Iodobromide Emulsion (AgI = 8.7 mol %, multilayer structure grain having silver amount ratio of 3:4:2, AgI content = 24, 0, 3 mol % from inside, sphere-equivalent diameter = 0.7 μm, variation coefficient of sphere-equivalent diameter = 25%, tabular grain, diameter/thickness ratio = 1.6) coating silver weight | 0.7 |
| Gelatin | 0.8 |
| ExS-9 | $5.2 \times 10^{-4}$ |
| ExS-10 | $1 \times 10^{-4}$ |
| ExS-12 | $0.3 \times 10^{-4}$ |
| ExM-5 | 0.1 |
| ExM-6 | 0.03 |
| ExY-8 | 0.02 |
| ExC-5 | 0.02 |
| ExC-8 | 0.01 |
| Solv-4 | 0.25 |
| Solv-5 | 0.06 |
| Solv-8 | 0.01 |
| Cpd-28 | $1 \times 10^{-4}$ |
| Layer 9: Interlayer | |
| Gelatin | 0.6 |
| Cpd-29 | 0.04 |
| Polyethylacrylate Latex | 0.12 |
| Solv-4 | 0.02 |
| Layer 10: Donor Layer having Interlayer Effect on Red-Sensitive Layer | |
| Silver Iodobromide Emulsion (AgI = 6 mol %, internally high AgI type having core/shell ratio of 2:1, sphere-equivalent diameter = 0.7 μm, variation coefficient of sphere-equivalent diameter = 25%, tabular grain, diameter/thickness ratio = 2.0) coating silver weight | 0.68 |
| Silver Iodobromide Emulsion (AgI = 4 mol %, homogeneous type, variation coefficient of sphere-equivalent diameter = 37%, tabular grain, diameter/thickness ratio = 3.0) coating silver weight | 0.19 |
| Gelatin | 1.0 |
| ExS-8 | $6 \times 10^{-4}$ |
| ExM-10 | 0.19 |
| Solv-4 | 0.20 |
| Layer 11: Yellow Filter Layer | |
| Yellow Colloidal Silver A | 0.12 |
| Gelatin | 0.8 |
| Cpd-30 | 0.13 |
| Solv-4 | 0.13 |
| Cpd-29 | 0.07 |
| Cpd-31 | 0.002 |
| H-4 | 0.13 |
| Layer 12: Low-Sensitivity Blue-Sensitive Emulsion Layer | |
| Silver Iodobromide Emulsion (AgI = 4.5 mol %, homogeneous AgI type, sphere-equivalent diameter = 0.7 μm, variation coefficient of sphere-equivalent diameter = 15%, tabular grain diameter/thickness ratio = 7.0) coating silver weight | 0.3 |
| Silver Iodobromide Emulsion (AgI = 3 mol %, homogeneous AgI type, sphere-equivalent diameter = 0.3 μm, variation coefficient of sphere-equivalent diameter = 30%, tabular grain, diameter/thickness ratio = 7.0) coating silver weight | 0.15 |
| Gelatin | 1.8 |
| ExS-11 | $9 \times 10^{-4}$ |
| ExC-5 | 0.06 |
| ExC-8 | 0.03 |
| ExY-9 | 0.14 |
| ExY-11 | 0.89 |
| Solv-4 | 0.42 |
| Layer 13: Interlayer | |
| Gelatin | 0.7 |
| ExY-12 | 0.20 |
| Solv-4 | 0.34 |
| Layer 14: High-Sensitivity Blue-Sensitive Emulsion Layer | |
| Silver Iodobromide Emulsion (AgI = 10 mol %, internally high AgI type, sphere-equivalent diameter = 1.0 μm, variation coefficient of sphere-equivalent diameter = 25%, multi-twined | 0.5 |

-continued

| | |
|---|---|
| tabular grain, diameter/thickness ratio = 2.0) | |
| coating silver weight | |
| Gelatin | 0.5 |
| ExS-11 | $1 \times 10^{-4}$ |
| ExY-9 | 0.01 |
| ExY-11 | 0.20 |
| ExC-5 | 0.02 |
| Solv-4 | 0.10 |
| Layer 15: 1st Protective Layer | |
| Fine Grain Silver Iodobromide Emulsion (AgI = 2 mol %, homogeneous AgI type sphere-equivalent diameter = 0.07 μm) | 0.12 |
| coating silver weight | |
| Gelatin | 0.9 |
| UV-4 | 0.11 |
| UV-5 | 0.16 |
| Solv-9 | 0.02 |
| H-4 | 0.13 |
| Cpd-32 | 0.10 |
| Polyethylacrylate Latex | 0.09 |
| Layer 16: 2nd Protective Layer | |
| Fine Grain Silver Bromide Emulsion (AgI = 2 mol %, homogeneous AgI type, sphere-equivalent diameter = 0.07 μm) | 0.36 |
| coating silver weight | |
| Gelatin | 0.55 |
| Polymethylmethacrylate Grains (diameter = 1.5 μm) | 0.2 |
| H-1 | 0.17 |

In addition to the above components, a stabilizer Cpd-23 (0.07 g/m$^2$) for an emulsion and a surfactant Cpd-33 (0.03 g/m$^2$) were added as coating aids to each layer.

Preparation of Sample 302

Sample 302 was prepared following the same procedures as for the sample 301 except that an average grain size of light-sensitive silver halide grains in the layers 2 and 6 of the sample 301 was set to be 0.5 μm.

Preparation of Sample 303

A sample 303 was prepared following the same procedures as for the sample 301 except that potassium iodide was added to the layer 11 of the sample 301 such that a coating weight became $1.0 \times 10^{-2}$ g/m$^2$.

Preparation of Samples 304–306

Samples 304 to 306 were prepared following the same procedures as for the sample 301 except that colloidal silver shown in Table 3 was used in place of the yellow colloidal silver A in the layer 11 of the sample 301.

Preparation of Sample 307

A sample 307 was prepared following the same procedures as for the sample 304 except that potassium iodide was added to the layer 11 of the sample 304 such that a coating weight became $1.0 \times 10^{-3}$ g/m$^2$.

The samples 301 to 307 prepared as described above were exposed with white light through a continuous optical wedge and subjected to the following development, and cyan, magenta, and yellow densities were measured.

Relative sensitivities of cyan, magenta, and yellow at a portion higher by a density of 0.2 than fog (minimum densities) were obtained.

Remaining silver amounts of the above developed samples were measured. In order to compare graininesses, a value 1,000 times an RMS graininess at a portion of a density of 1.5 was obtained.

The results are summarized in Table 3.

Processing Method

| Step | Time | Temperature |
|---|---|---|
| Color Development | 3 min. 15 sec. | 38° C. |
| Bleaching | 1 min. 00 sec. | 38° C. |
| Bleach-Fixing | 3 min. 15 sec. | 38° C. |
| Washing (1) | 40 sec. | 35° C. |
| Washing (2) | 1 min. 00 sec. | 35° C. |
| Stabilization | 40 sec. | 38° C. |
| Dry | 1 min. 15 sec. | 55° C. |

The processing solution compositions will be described below.

| Color Developing Solution | (g) |
|---|---|
| Diethylenetriaminepentaacetic Acid | 1.0 |
| 1-hydroxyethylidene-1,1-diphosphonic Acid | 3.0 |
| Sodium Sulfite | 4.0 |
| Potassium Carbonate | 30.0 |
| Potassium Bromide | 1.4 |
| Potassium Iodide | 1.5 mg |
| Hydroxylamine Sulfate | 2.4 |
| 4-[N-ethyl-N-(β-hydroxyethyl)amino]-2-methylaniline Sulfate | 4.5 |
| Water to make | 1.0 l |
| pH | 10.05 |
| Bleaching Solution | (g) |
| Ferric Ammonium Ethylenediaminetetraacetate (Dihydrate) | 120.0 |
| Disodium Ethylenediaminetetraacetate | 10.0 |
| Ammonium Bromide | 100.0 |
| Ammonium Nitrate | 10.0 |
| Bleaching Accelerator | 0.005 mol |

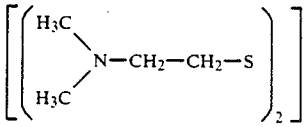

| | |
|---|---|
| Ammonia Water (27%) | 15.0 |
| Water to make | 1.0 l |
| pH | 6.3 |
| Bleach-Fixing Solution | (g) |
| Ferric Ammonium Ethylenediaminetetraacetate (Dihydrate) | 50.0 |
| Disodium Ethylenediaminetetraacetate | 5.0 |
| Sodium Sulfite | 12.0 |
| Ammonium Thiosulfate Aqueous Solution (70%) | 240.0 |
| Ammonia Water (27%) | 6.0 |
| Water to make | 1.0 l |
| pH | 7.2 |

Washing Solution

Tap water was supplied to a mixed-bed column filled with an H type strongly acidic cation exchange resin (Amberlite IR-120B, available from Rohm & Haas Co.) and an OH type anion exchange resin (Amberlite IR-400) to set the concentrations of calcium and magnesium ion to be 3 mg/l or less. Subsequently, 20 mg/l of sodium isocyanurate dichloride and 1.5 g/l of sodium sulfate were added. The pH of the solution fell within the range of 6.5 to 7.5.

| Stabilizing Solution | (g) |
|---|---|
| Formalin (37%) | 2.0 |
| Polyoxyethylene-p-monononyl-phenylether (average poly- | 0.3 |

-continued

| Stabilizing Solution | (g) |
|---|---|
| merization degree = 10) | |
| Disodium Ethylenediaminetetraacetate | 0.05 |
| Water to make | 1.0 λ |
| pH | 5.0 to 8.0 |

As is apparent from the results shown in Table 3, according to the present invention, a fog can be reduced lower than in the comparative examples without reducing the sensitivity or degrading the graininess and desilvering property.

TABLE 3

| Sample No. | Yellow Colloidal Silver used in Layer 11 | Additive added to Layer 11 | Relative Sensitivity | | | Graininess | | | Remaining Silver Amount | $D_{min}$ | | |
|---|---|---|---|---|---|---|---|---|---|---|---|---|
| | | | Cyan | Magenta | Yellow | Cyan | Magenta | Yellow | | Cyan | Magenta | Yellow |
| 301 (comparative Example) | A | — | 100 | 100 | 100 | 16.9 | 17.4 | 21.5 | 7.0 mg/cm$^2$ | 0.07 | 0.43 | 0.76 |
| 302 (comparative Example) | A | — | 105 | 104 | 104 | 17.7 | 18.2 | 22.0 | 6.9 | 0.08 | 0.44 | 0.77 |
| 303 (comparative Example) | A | KI | 95 | 91 | 90 | 16.9 | 17.3 | 21.4 | 12.5 | 0.07 | 0.42 | 0.75 |
| 304 (Present Invention) | B | — | 100 | 101 | 100 | 16.8 | 17.4 | 21.4 | 6.8 | 0.07 | 0.40 | 0.73 |
| 305 (Present Invention) | C | — | 99 | 102 | 100 | 16.9 | 17.3 | 21.4 | 6.9 | 0.07 | 0.39 | 0.72 |
| 306 (Present Invention) | D | — | 100 | 101 | 101 | 16.9 | 17.3 | 21.4 | 7.0 | 0.07 | 0.39 | 0.72 |
| 307 (Present Invention) | B | KI | 99 | 98 | 97 | 16.8 | 17.2 | 21.4 | 7.3 | 0.07 | 0.39 | 0.72 |

TABLE 4

C-1

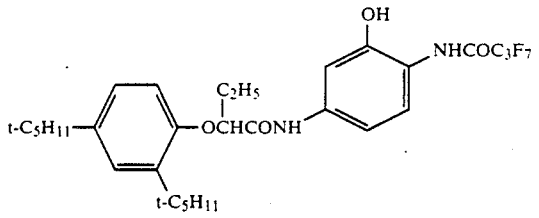

C-2

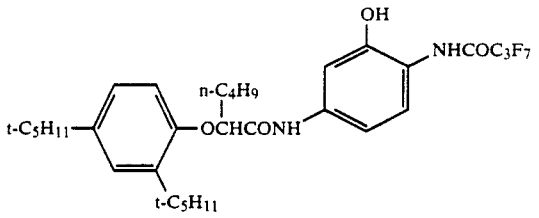

TABLE 4-continued
C-3
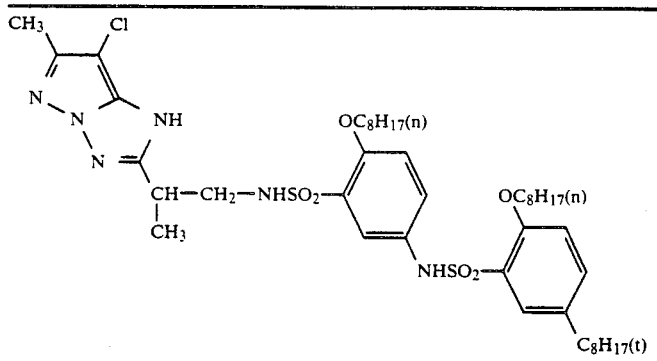
C-4
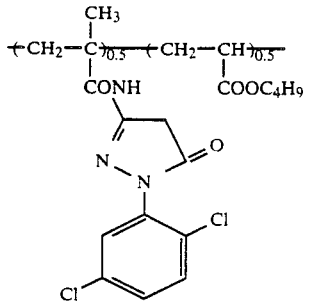
C-5
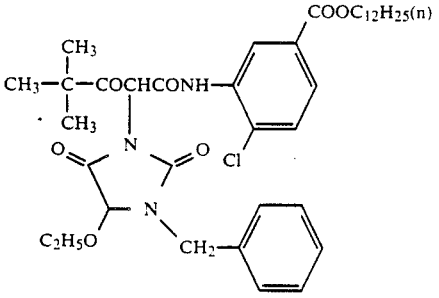
C-6
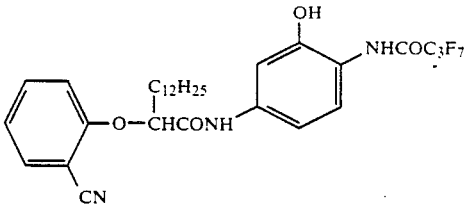
C-7
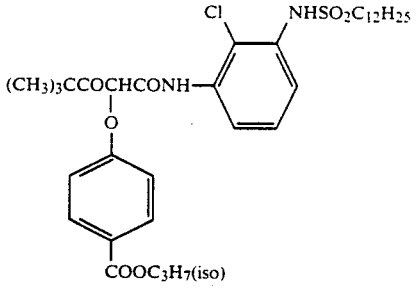
C-8
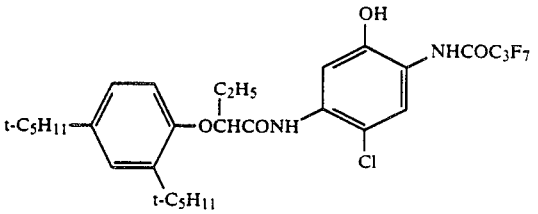

TABLE 4-continued
C-9
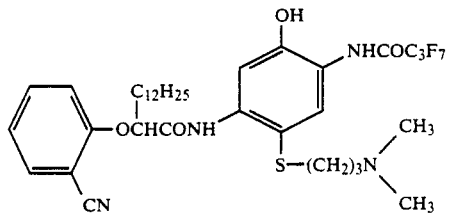
C-10
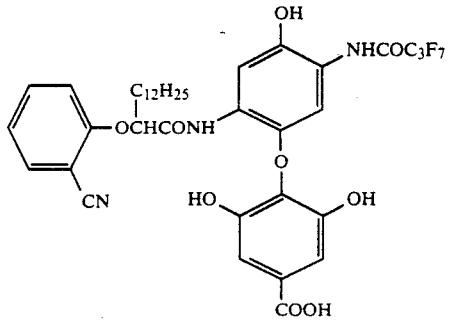
U-1
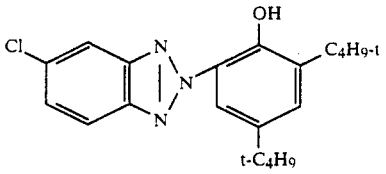
U-2
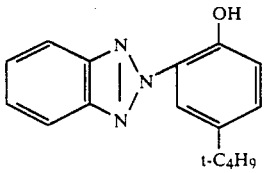
U-3
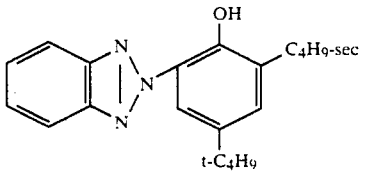
U-4
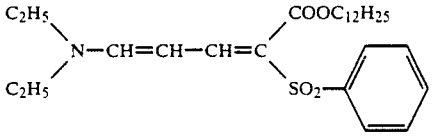
H-1
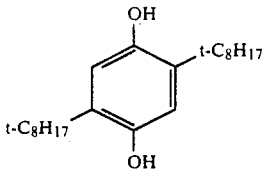
H-2
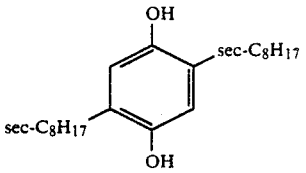

TABLE 4-continued
H-3
$CH_2{=}CHSO_2CH_2CONHCH_2$
$CH_2{=}CHSO_2CH_2CONHCH_2$
O-1
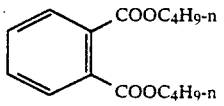
O-2
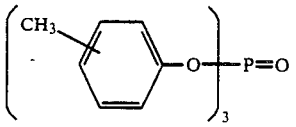
S-1
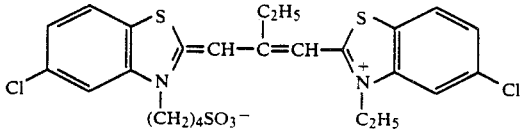
S-2
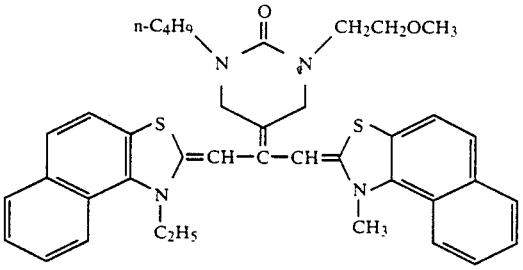
S-3
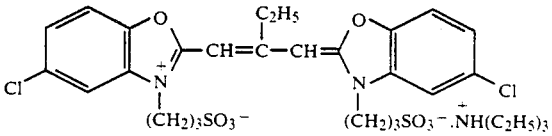
S-33
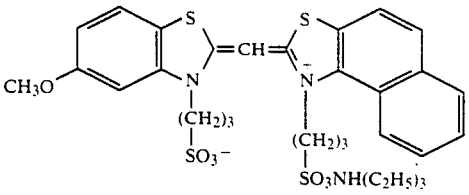
S-4
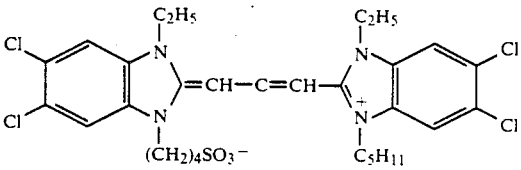
S-5
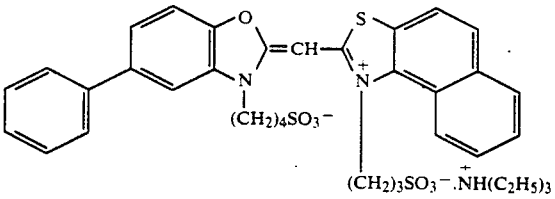
A-1
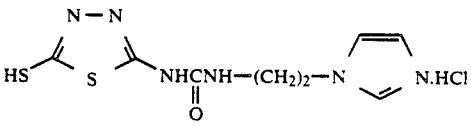

TABLE 4-continued
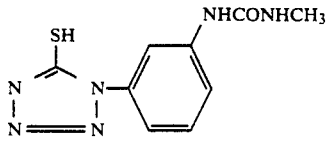
A-2
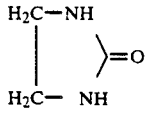
A-3
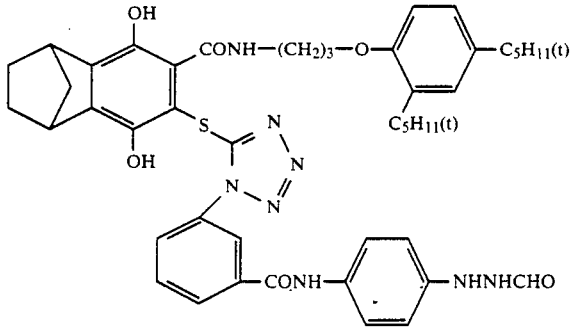
A-4
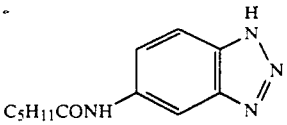
A-5
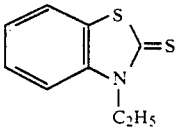
A-6
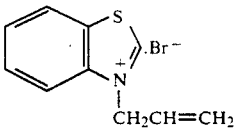
A-7
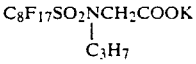
A-8
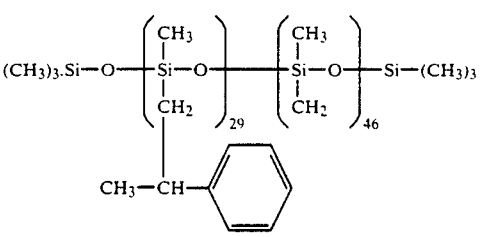
A-9
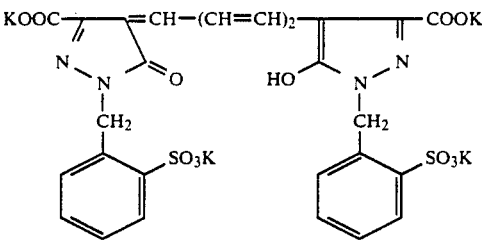
A-10

TABLE 4-continued
A-11
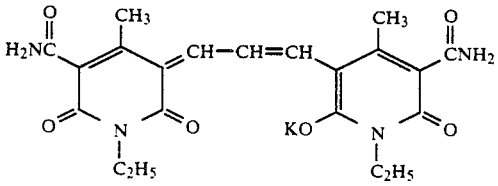
A-12
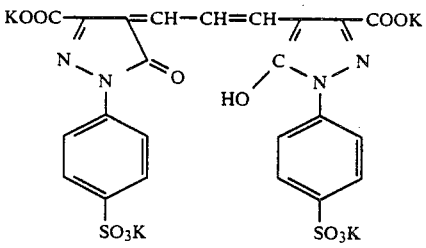
A-13
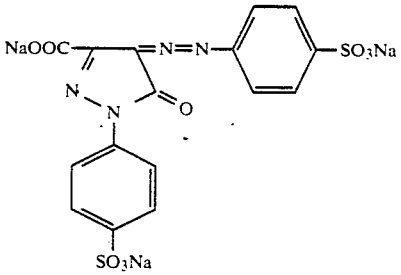
A-14
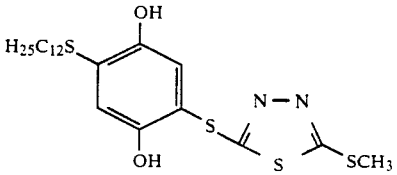
A-15
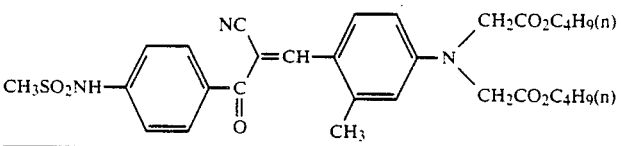
TABLE 5
ExS-1
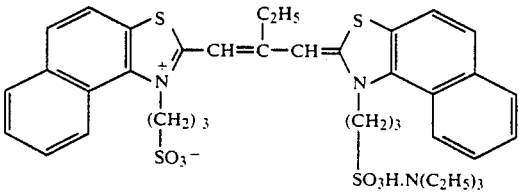
ExS-2
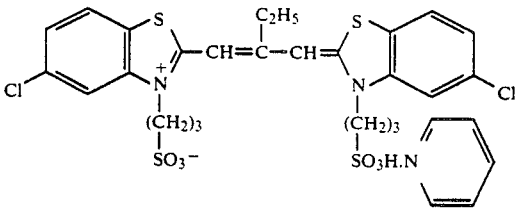

TABLE 5-continued
ExS-3
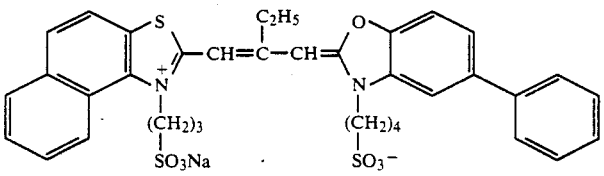
ExS-4
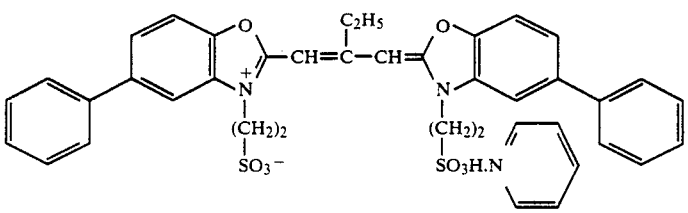
ExS-5
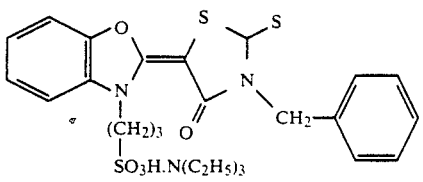
ExS-6
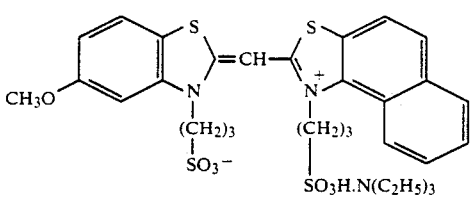
Cpd-1
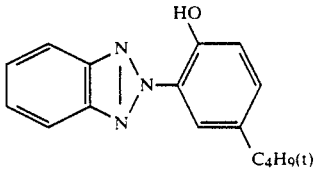
Cpd-2
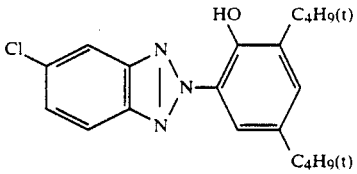
Cpd-3
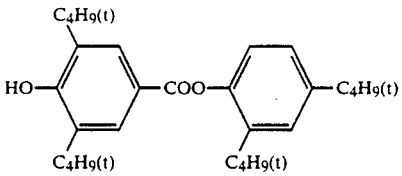
Cpd-4
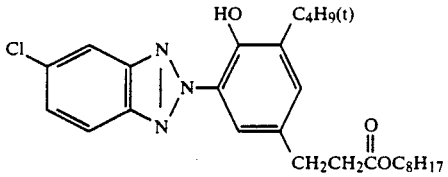

TABLE 5-continued
Cpd-5
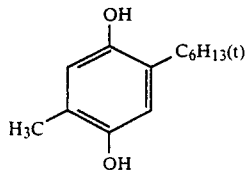
Cpd-6
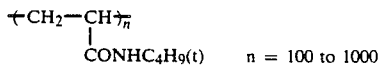
Cpd-7
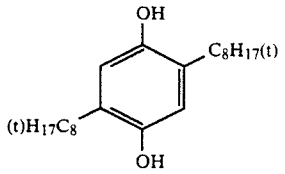
Cpd-8
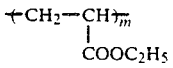
Cpd-9
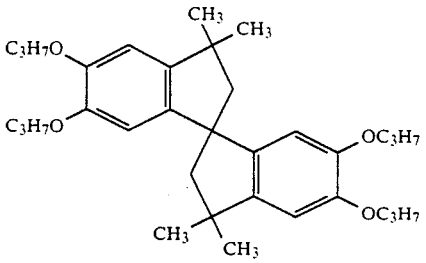
Cpd-10
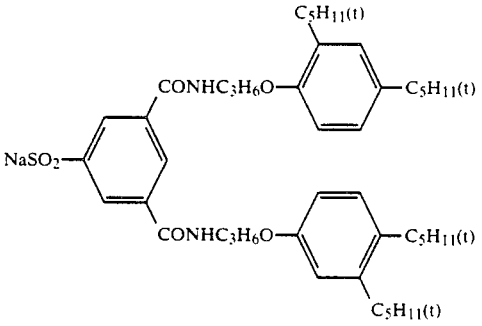
Cpd-11
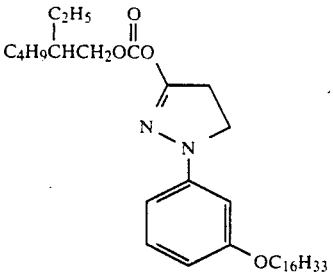
Cpd-12
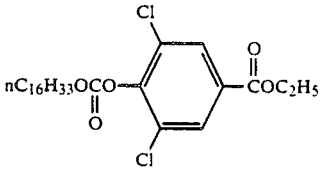

TABLE 5-continued
Cpd-13
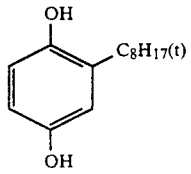
Cpd-14
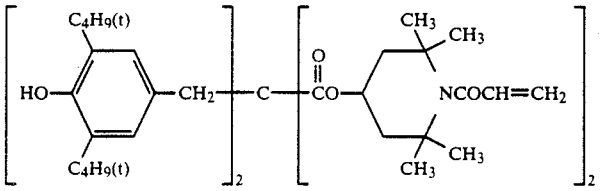
Cpd-15
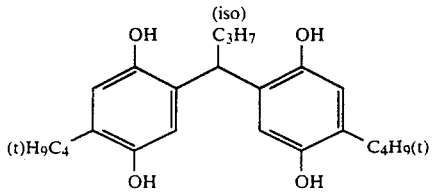
Cpd-16
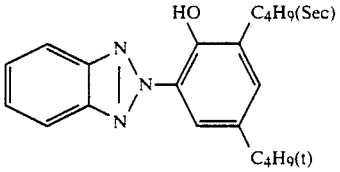
Cpd-17
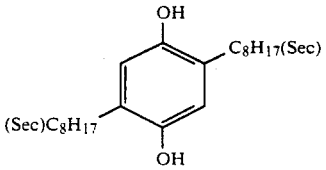
Cpd-18
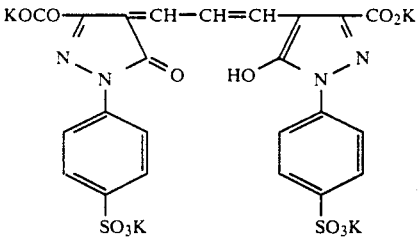
Cpd-19
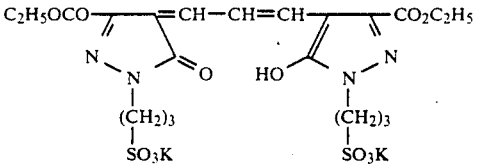
Cpd-20
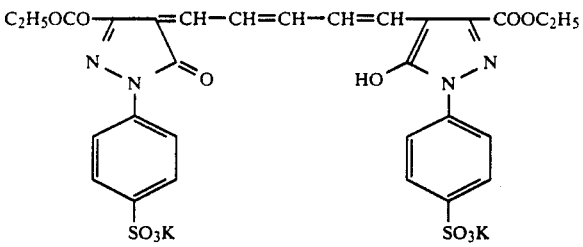

TABLE 5-continued
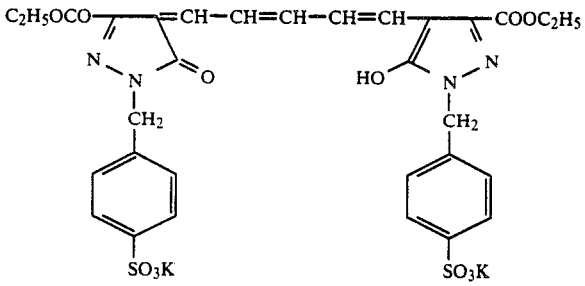
Cpd-21
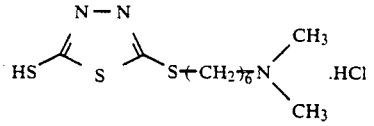
Cpd-22
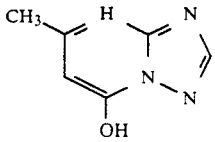
Cpd-23
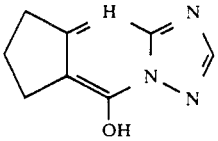
Cpd-24
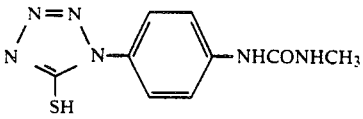
Cpd-25
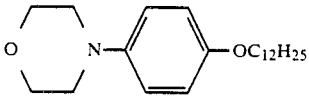
Cpd-26
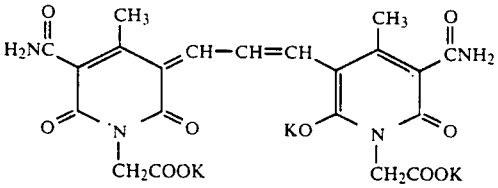
Cpd-27
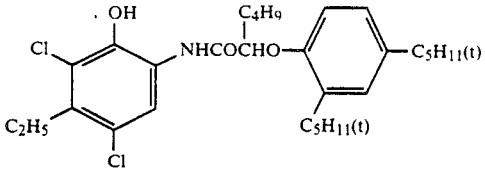
EXC-1
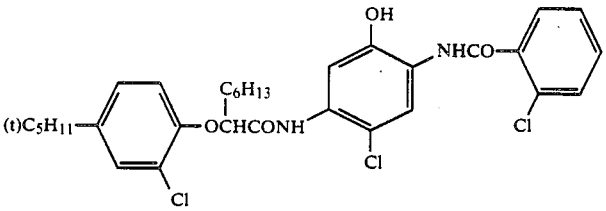
EXC-2

TABLE 5-continued
EXC-3
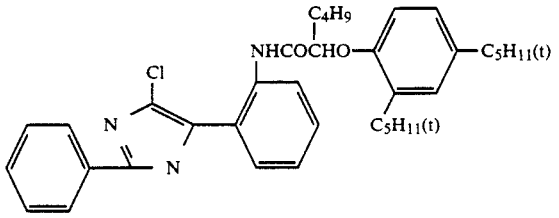
EXM-1
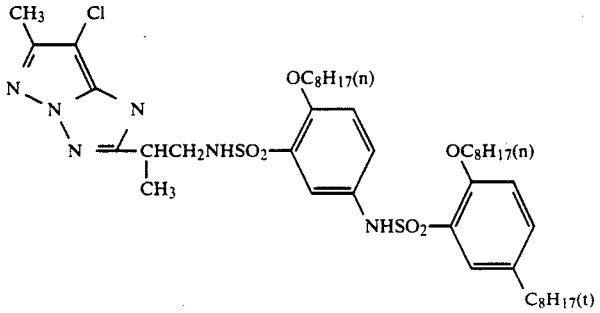
EXM-2
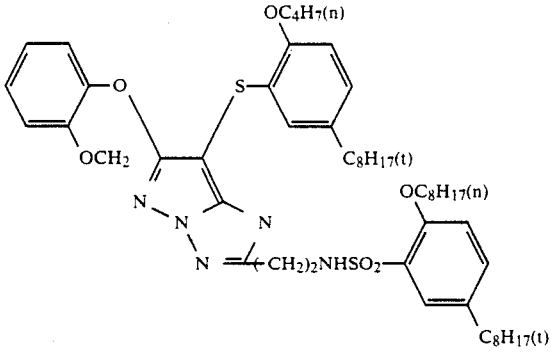
EXM-3
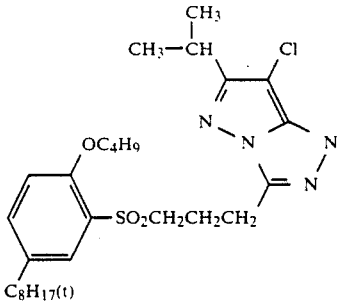
EXC-4
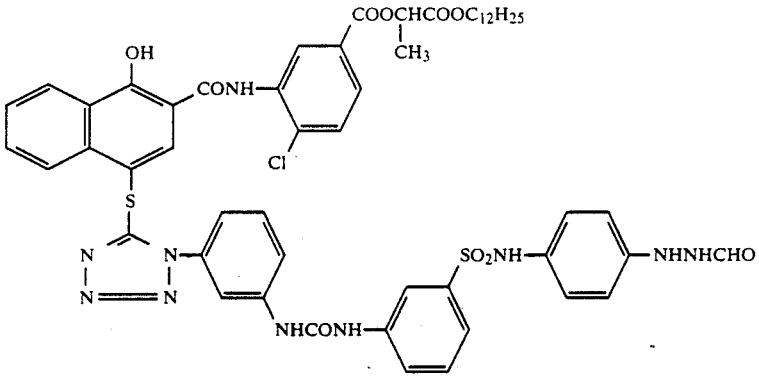

TABLE 5-continued

| | |
|---|---|
| 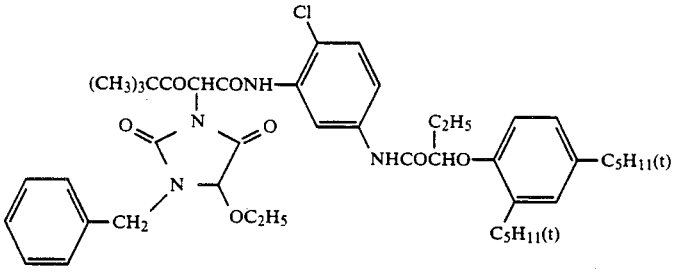 | EXY-1 |
| 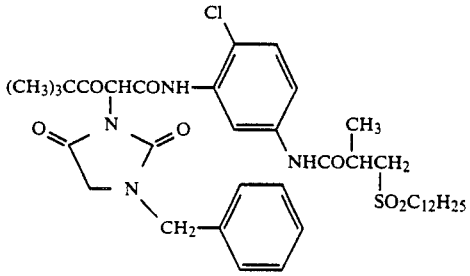 | EXY-2 |
| di(2-ethylhexyl)sebacate | Solv-1 |
| trinonylphosphate | Solv-2 |
| di(3-methylhexyl)phthalate | Solv-3 |
| tricresylphosphate | Solv-4 |
| dibutylphthalate | Solv-5 |
| trioctylphosphate | Solv-6 |
| di(2-ethylhexyl)phthalate | Solv-7 |
| 1,2-bis(vinylsulfonylacetoamido)ethane | H-1 |
| 4,6-dichloro-2-hydroxy-1,3,5-triazine Na salt | H-2 |
| 7-(3-ethoxythiocarbonylaminobenzamido)-9-methyl-10-propagyl-1,2,3,4-tetrahydroacrydinium trifluoromethanesulfonate | ExZK-1 |
| 2-[4-{3-[3-{3-[5-{3-[2-chloro-5-(1-dodecyloxycarbonylethoxycarbonyl) phenylcarbamoyl]-4-hydroxy-1-naphthylthio} tetrazole-1-yl]phenyl}ureido] benzenesulfonamido}phenyl]-1-formylhydrazine | ExZK-2 |

TABLE 6

| | |
|---|---|
| 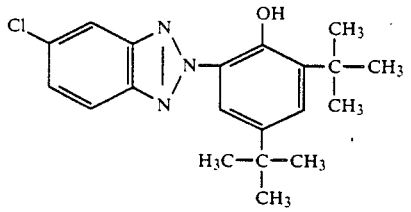 | UV-1 |
| 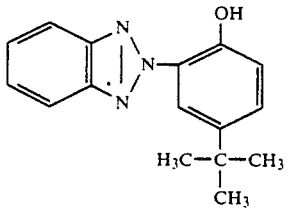 | UV-2 |
| 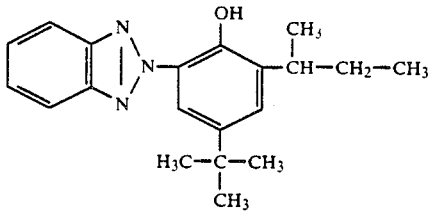 | UV-3 |

TABLE 6-continued
UV-4
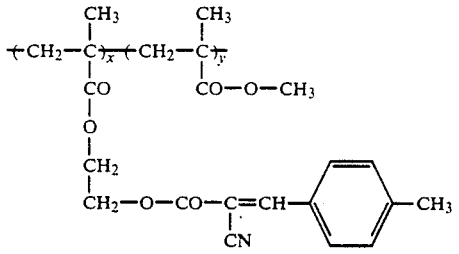
(x/y = 7/3 weight ratio)
UV-5
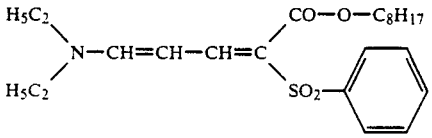
Solv-4
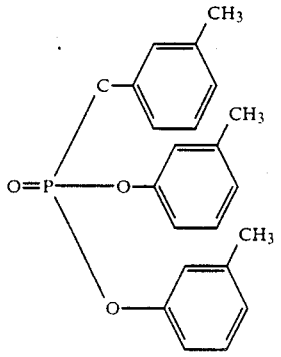
Solv-5
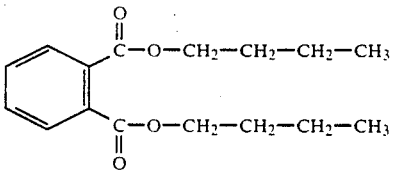
Solv-8
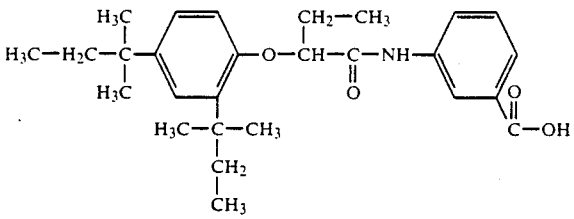
Solv-9
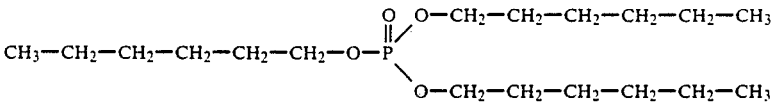

TABLE 6-continued
ExF-1
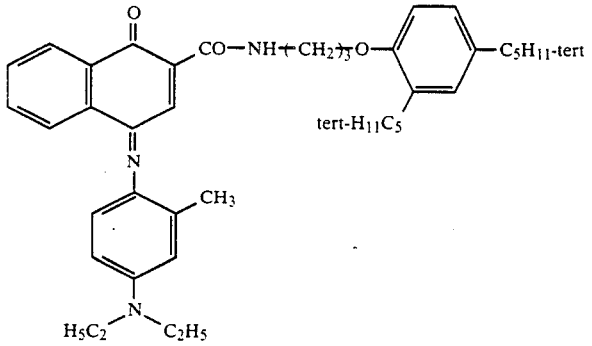
ExF-2
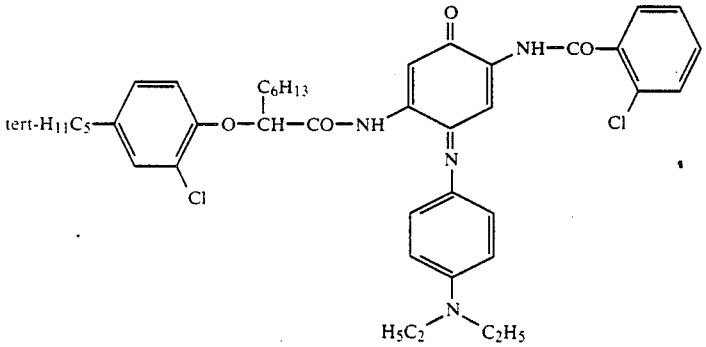
ExS-7
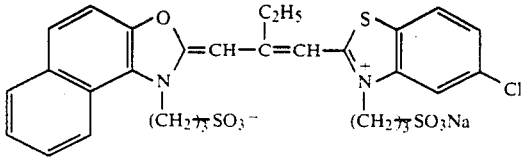
ExS-2
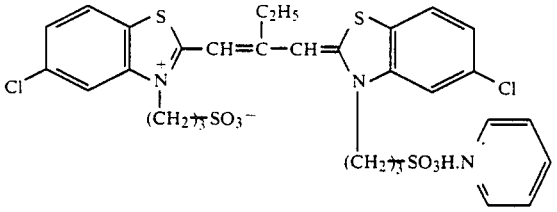
ExS-8
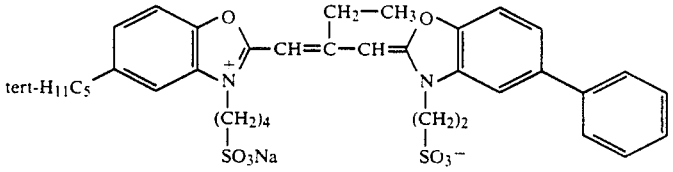
ExS-9
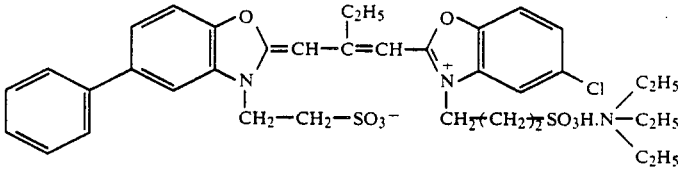

TABLE 6-continued
ExS-10
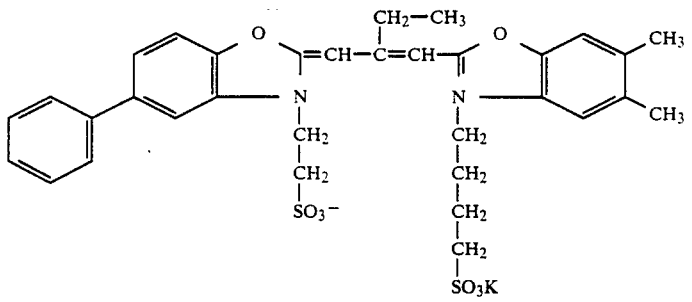
ExS-11
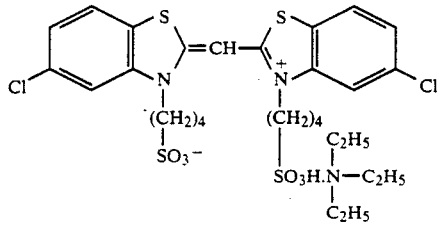
ExS-1
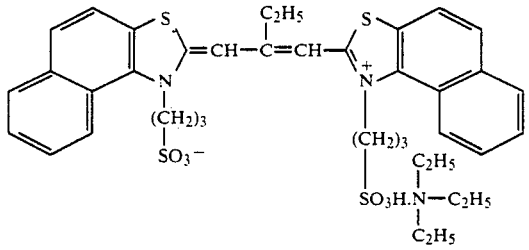
ExS-12
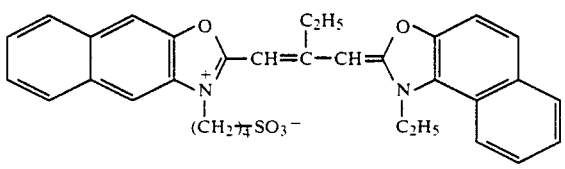
ExC-5
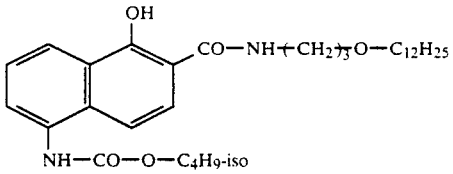
ExC-6
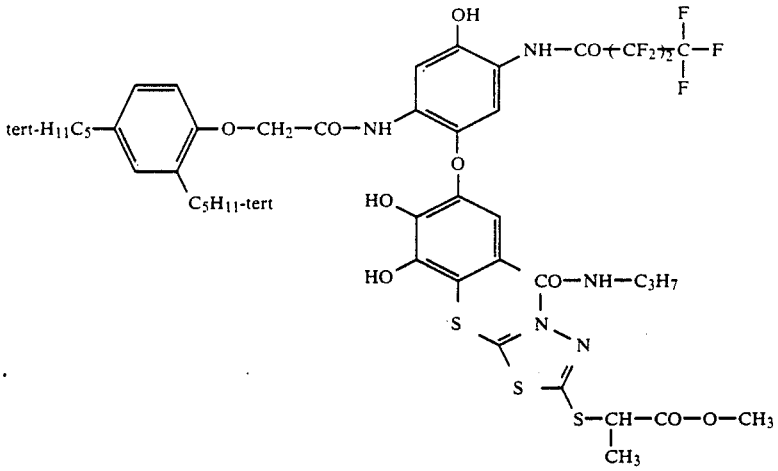

TABLE 6-continued
ExC-7
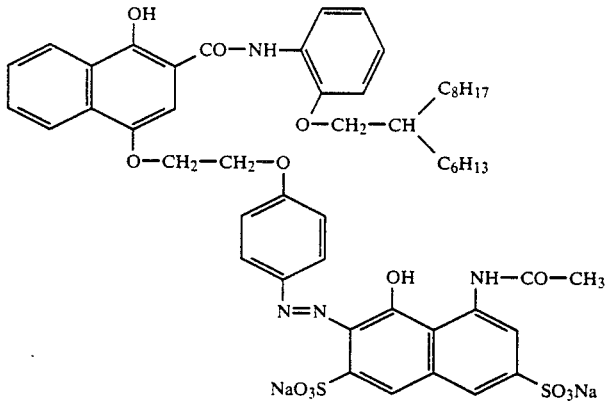
ExC-8
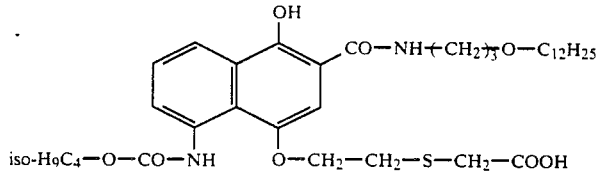
ExM-5
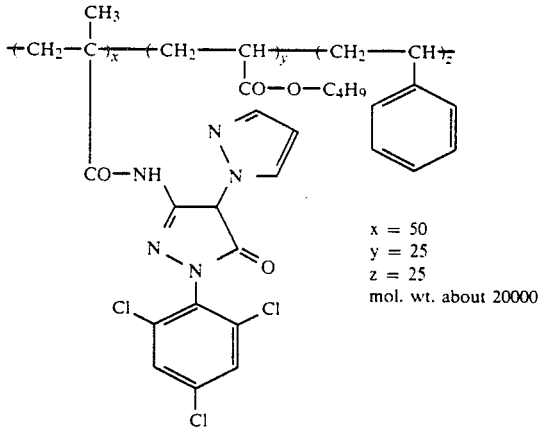
x = 50
y = 25
z = 25
mol. wt. about 20000
ExM-6
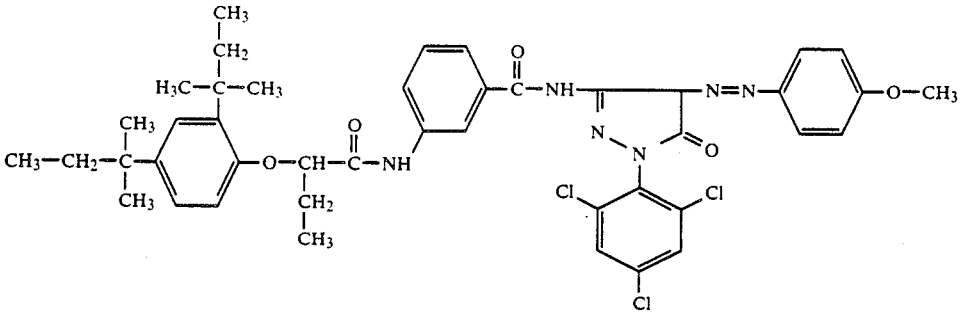

TABLE 6-continued
ExM-7
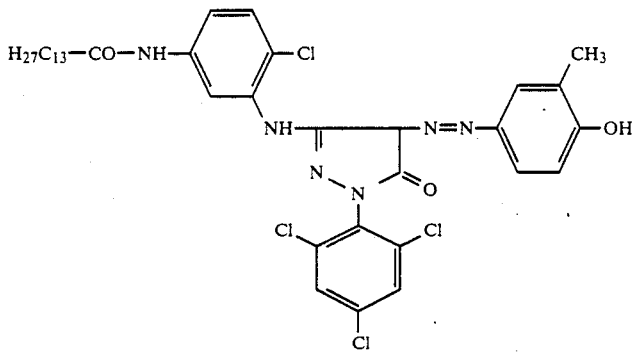
ExM-10
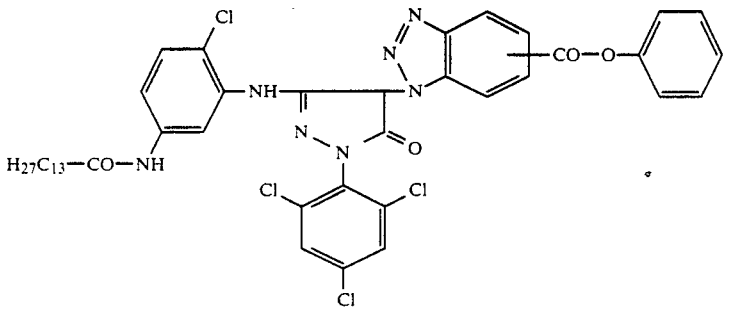
ExY-8
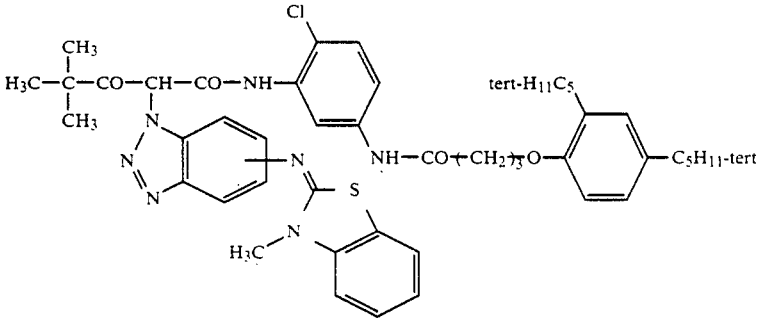
ExY-9
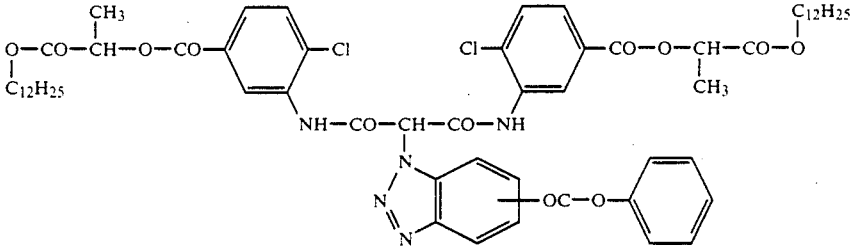
ExY-11
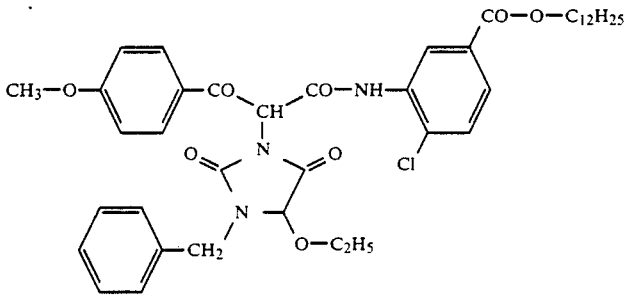

TABLE 6-continued

ExY-12

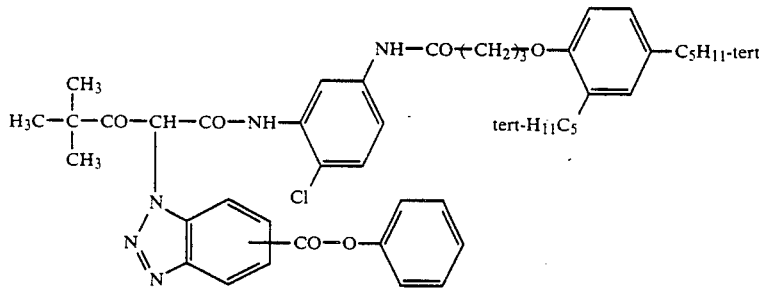

What is claimed is:

1. A silver halide color photographic light-sensitive material comprising at least one red-sensitive silver halide emulsion layer, at least one green-sensitive silver halide emulsion layer and at least one blue-sensitive silver halide emulsion layer, and a yellow filter layer containing yellow colloidal silver, on a support, wherein, the average grain size of grains in at least one of the light-sensitive silver halide emulsions is 0.4 μm or less, the maximum absorption peak of yellow colloidal silver in the yellow filter layer appears at 430 to 450 nm, ¼ absorption of the maximum absorption at a longer wavelength side occurring in the range of 500 to 560 nm, and wherein said colloidal silver is produced with hydrogen peroxide and silver nitrate.

2. A silver halide color photographic light-sensitive material according to claim 1, wherein dextrin is also used in the production of said colloidal silver.

3. A silver halide color photographic light-sensitive material according to claim 1, wherein said hydrogen peroxide is used in an amount of 0.01 to 3 liters per kg of said silver nitrate.

4. A silver halide color photographic light-sensitive material according to claim 2, wherein said dextrin is used in an amount of 0.1 to 10 kg per kg of said silver nitrate.

* * * * *